US007695289B1

(12) United States Patent
Sato et al.

(10) Patent No.: US 7,695,289 B1
(45) Date of Patent: Apr. 13, 2010

(54) CONNECTOR

(75) Inventors: Koki Sato, Shinagawa (JP); Hideo Miyazawa, Shinagawa (JP); Tohru Yamakami, Shinagawa (JP); Kazuhiro Mizukami, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/570,191

(22) Filed: Sep. 30, 2009

(30) Foreign Application Priority Data

Nov. 5, 2008 (JP) ..... 2008-284133
Jul. 10, 2009 (JP) ..... 2009-164113

(51) Int. Cl.
*H01R 12/00* (2006.01)

(52) U.S. Cl. ..... 439/78

(58) Field of Classification Search ..... 439/78, 439/83, 862
See application file for complete search history.

(56) References Cited

U.S. PATENT DOCUMENTS 4,743,205 A * 5/1988 Mitani et al. ..... 439/78
4,790,764 A * 12/1988 Kawaguchi et al. ..... 439/78
5,452,512 A * 9/1995 Foley et al. ..... 29/874
5,630,720 A * 5/1997 Kocher ..... 439/78

FOREIGN PATENT DOCUMENTS

JP 02-223172 9/1990

* cited by examiner

*Primary Examiner*—Tho D Ta
(74) *Attorney, Agent, or Firm*—IPUSA, PLLC

(57) ABSTRACT

A connector includes a housing and a contact. The contact includes a first part including a first terminal part and a first connection part; a second part including a second terminal part and a second connection part, and a third part including an elastic part having a first end and a second end connected to the first part and the second part, respectively. The first connection part and the second connection part face each other across a gap. The second terminal part is configured to come into press contact with an electrode in response to fixation of the housing to a board. The third part is configured to elastically deform in response to attachment of a plug to the housing and/or the fixation of the housing to the board, so as to cause the first connection part and the second connection part to come into contact and be electrically connected.

14 Claims, 21 Drawing Sheets

CONNECTOR

BACKGROUND OF THE INVENTION

1. Field of the Invention

The present invention relates to connectors.

2. Description of the Related Art

Recent developments in communications technologies have aroused a demand for connectors that enable transmission of signals at ultra-high speed. This type of connector has multiple signal contacts and multiple ground contacts, and shields the signal contacts by surrounding them with the corresponding ground contacts, thereby preventing noise from entering the signal contacts. (See, for example, Japanese Laid-Open Patent Application No. 2-223172.)

This type of connector is mounted on a board. Surface mounting, which makes it possible to reduce size, increase density, and lower cost, has become a mainstream method of mounting electronic components on boards. This has also promoted surface mounting of connectors on boards. For example, the contacts of a connector and corresponding interconnects (lands) of a wiring board are temporarily joined with solder cream and thereafter subjected to a reflow process so as to be soldered.

SUMMARY OF THE INVENTION

According to an aspect of the present invention, a connector includes a housing to be fixed to a board; and a contact provided in the housing, the contact being configured to be connected to a plug to be attached to the housing, the contact including a first contact part including a body part, a first terminal part provided at a first end of the body part and configured to connect to the plug, and a first connection part provided at a second end of the body part; one or more second contact parts each including a second terminal part at a first end thereof and a second connection part at a second end thereof, the second terminal part being configured to connect to an electrode provided on the board; and one or more third contact parts each including an elastically deformable elastic part having a first end thereof connected to the first contact part and a second end thereof connected to the second contact part, the third contact part being configured to hold the first connection part and the second connection part so that the first connection part and the second connection part face each other across a gap, wherein the second terminal part is configured to be brought into press contact with the electrode by an elastic force to be generated in the third contact part in response to fixation of the housing to the board, and the third contact part is configured to elastically deform in response to at least one of attachment of the plug to the housing and the fixation of the housing to the board, so as to cause the first connection part and the second connection part to come into contact and be electrically connected.

According to an aspect of the present invention, a connector includes a housing to be fixed to a board; and one or more contacts provided in the housing, the contacts being configured to be connected to corresponding plugs to be attached to the housing, wherein the contacts include a ground contact, the ground contact including a substantially cylindrical ground contact body part; a first terminal part provided at a first end of the ground contact body part to be connected to a corresponding one of the plugs; and a plurality of second terminal parts extending from a second end of the ground contact body part to be connected to the board, the second terminal parts each including a first member extending from the ground contact main body part toward the board; and a second member having a curved shape so as to have an end part thereof facing the first member across a gap, the second member being configured to be deformed to cause the end part thereof to come into contact with the first member and to be brought into press contact with an electrode of the board by an elastic force generated in the second member by fixation of the housing to the board.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

As described above, the contacts of the conventional connector are soldered to the board. Therefore, if the board warps to generate a gap between the contacts and the interconnects of the board, this prevents the contacts from being soldered properly to the board, thus causing the problem of reduction in the reliability of the connection between the connector and the board.

Further, according to the conventional configuration where the contacts and the board are soldered, removal of the connector from the board for repairing is accompanied by heating soldered points to melt solder. Therefore, there is also the problem of poor repairability.

A description is given below, with reference to the accompanying drawings, of embodiments of the present invention.

First Embodiment

Figure 1:
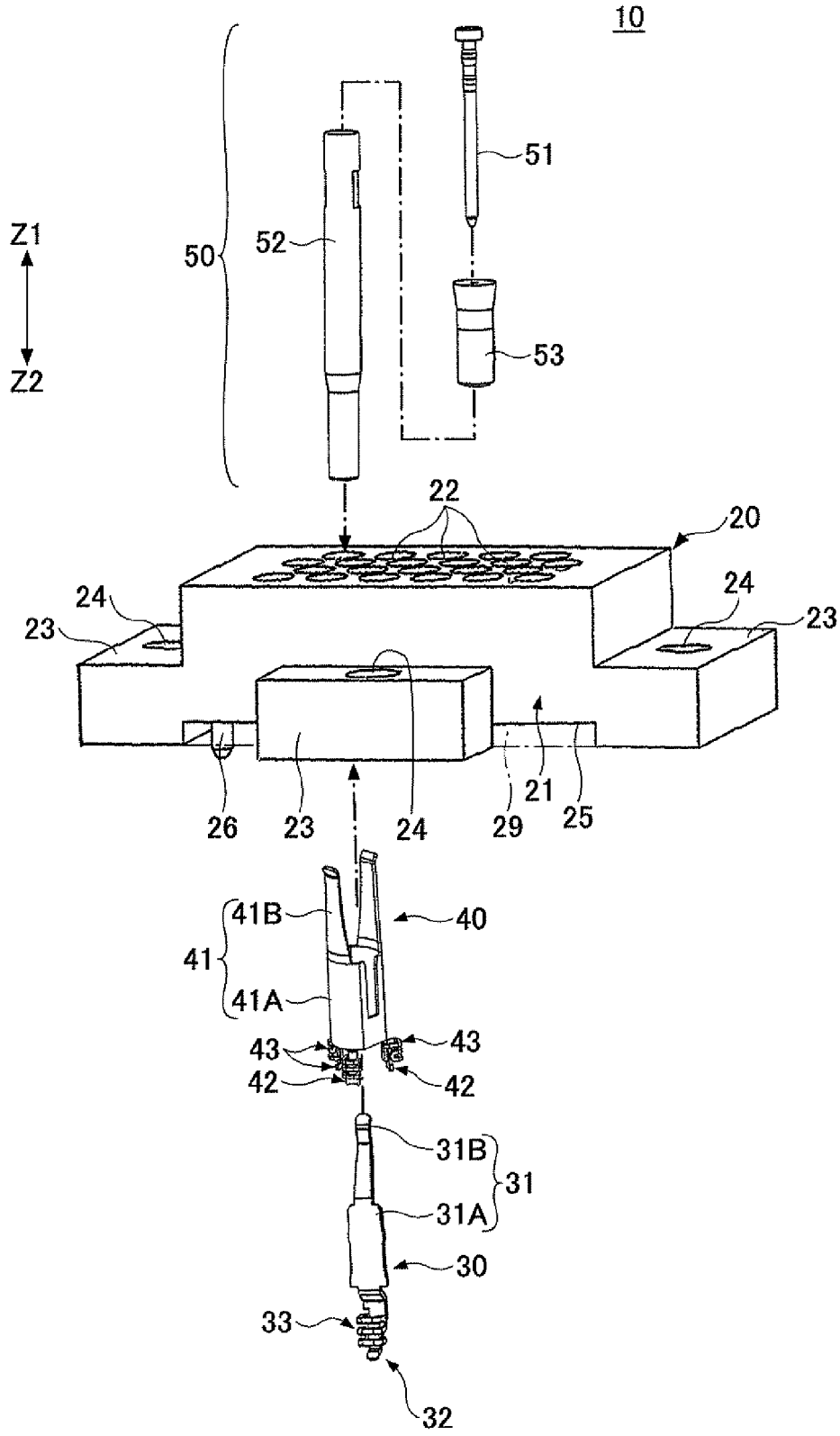
FIG. 1 is an exploded perspective view of a connector according to a first embodiment of the present invention.
Figure 2:
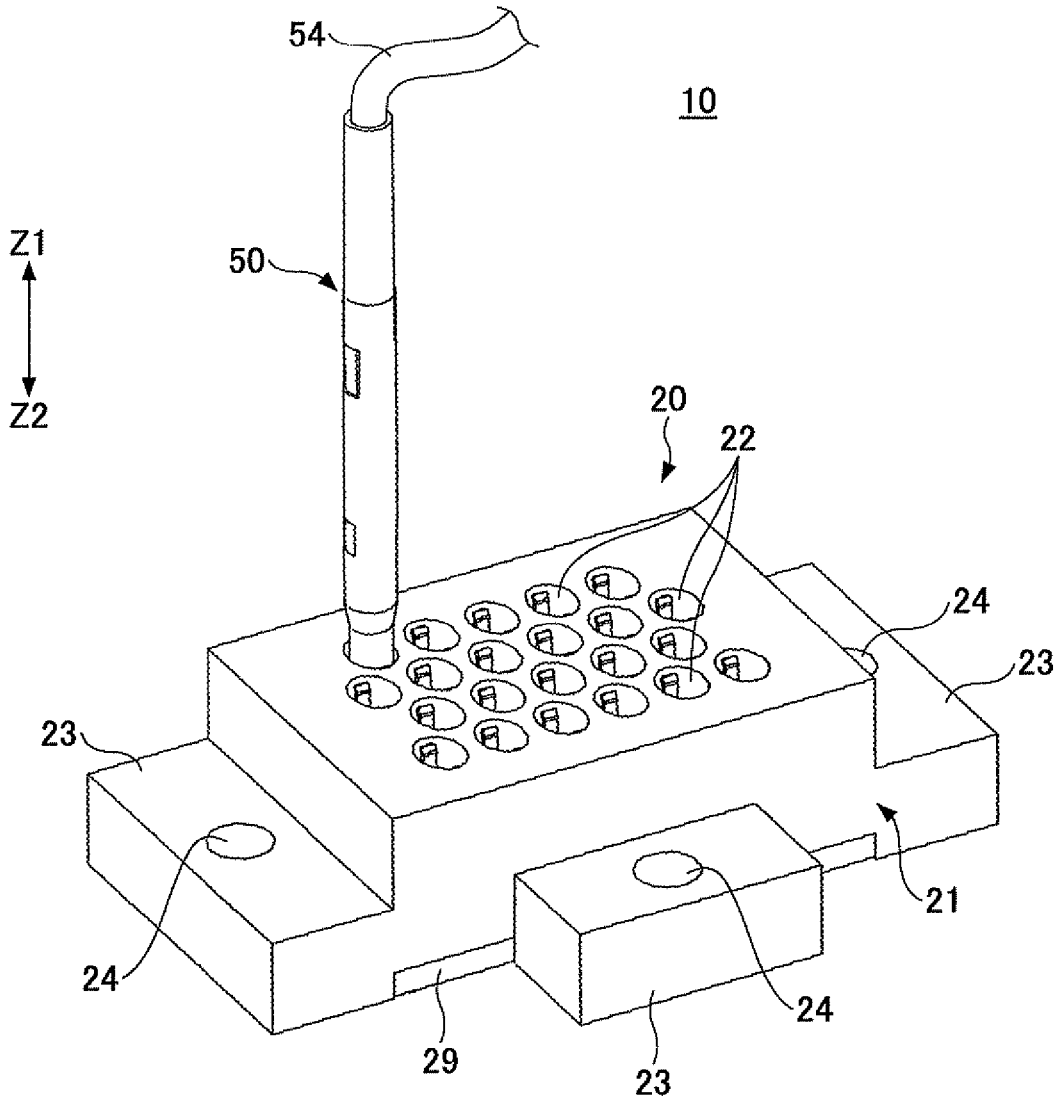
FIG. 2 is a perspective view of the connector to which a plug is attached according to the first embodiment of the present invention.

FIG. 1 and FIG. 2 are diagrams illustrating a connector 10 according to a first embodiment of the present invention. FIG. 1 is an exploded perspective view of the connector 10. FIG. 2 is a perspective view of the connector 10, illustrating its exterior.

The connector 10 includes a connector housing 20, signal contacts 30, and ground contacts 40. The connector 10 is to be surface-mounted on a board 60 (FIG. 5), and electrically connects a plug 50 inserted into the connector 10 and the board 60.

The connector housing 20 is formed by molding thermoplastic resin such as LCP (liquid crystal polymer). The connector housing 20 includes a body part 21. Multiple attachment holes 22 to which the signal contacts 30 and the ground contacts 40 are attached are formed through the body part 21. Further, the connector housing 20 includes flange parts 23 on four peripheral sides. Each of the flange parts 23 has an insertion hole 24 into which a fixation screw (not graphically illustrated) is to be inserted that is used at the time of mounting the connector 10 on the board 60.

Figure 3:
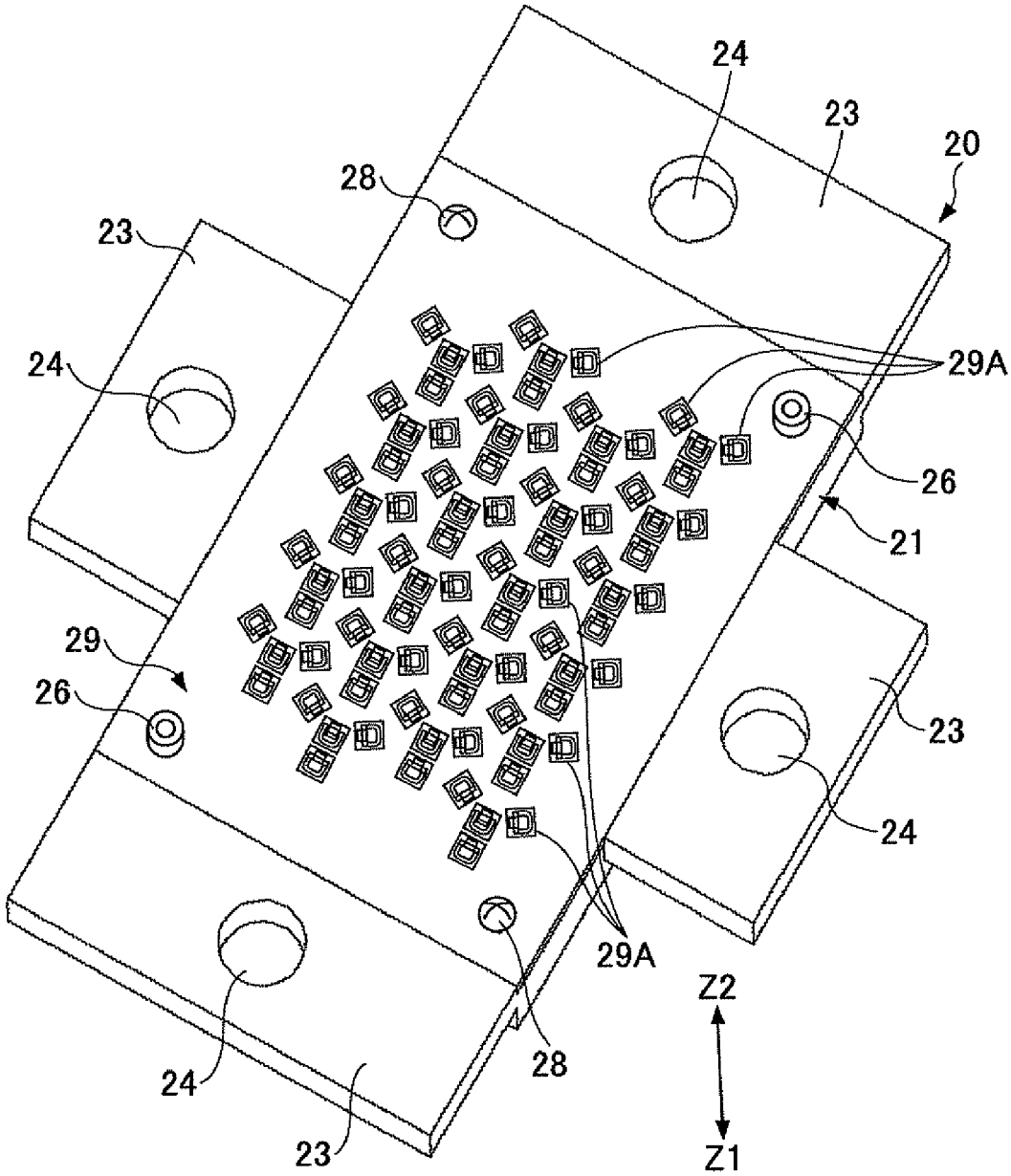
FIG. 3 is a bottom-side perspective view of the connector according to the first embodiment of the present invention.
Figure 4:
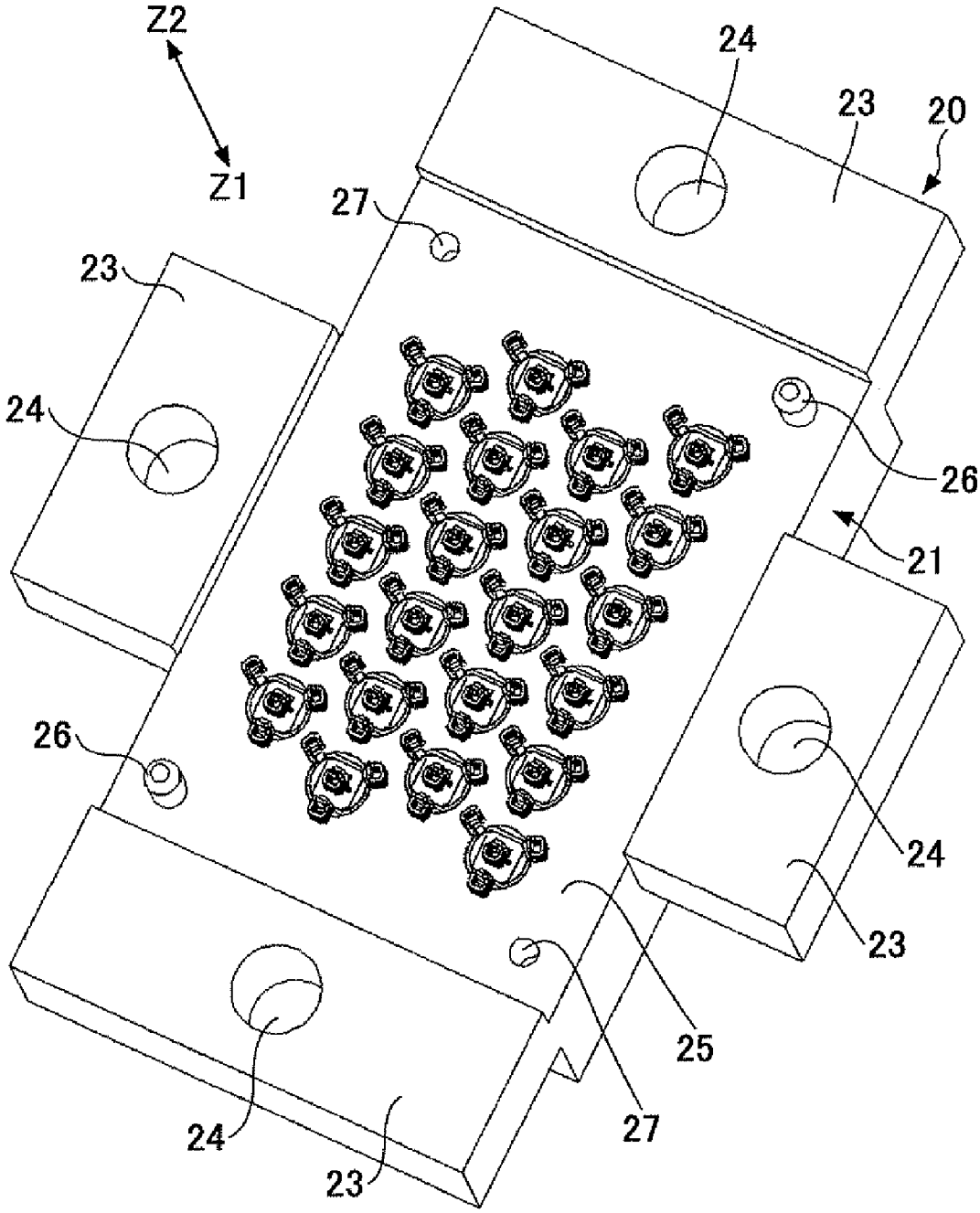
FIG. 4 is a bottom-side perspective view of the connector with a bottom plate according to the first embodiment of the present invention.

FIG. 3 is a bottom-side perspective view of the connector 10. FIG. 4 is a bottom-side perspective view of the connector 10 without a bottom plate 29.

Referring to FIG. 4, a step part 25 for attaching the bottom plate 29 (described below) is formed on the bottom surface of the connector housing 20. Further, positioning projections 26 are provided and screw holes 27 are formed at predetermined positions of the step part 25.

Figure 5:
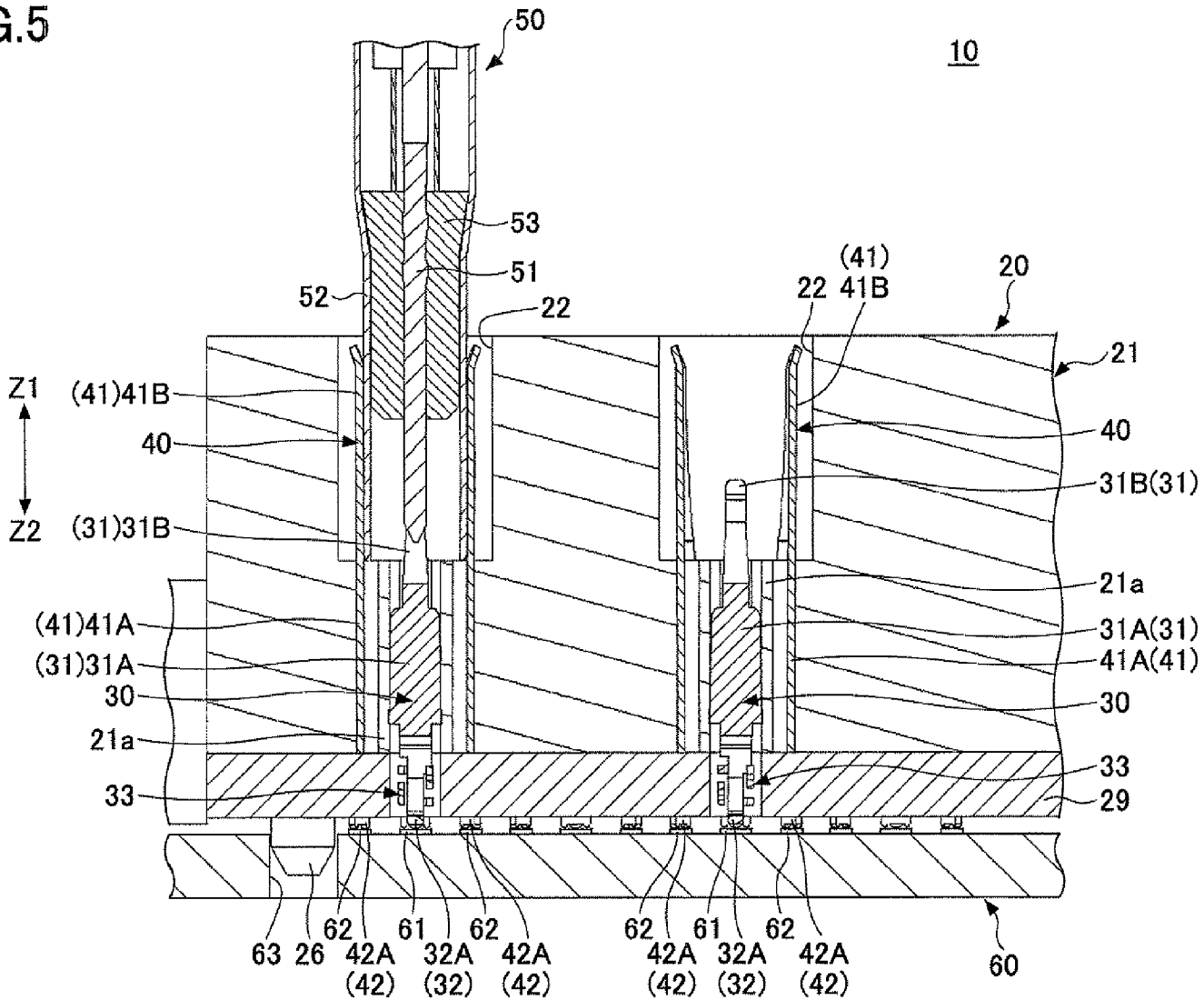
FIG. 5 is a cross-sectional view of part of the connector according to the first embodiment of the present invention.

Here, a brief description is given of the plug 50. Referring to FIG. 1 and FIG. 5, the plug 50 includes a plug pin 51, a ground member 52, and an insulator 53. For example, the plug pin 51 is press-fit into a small hole formed through the insulator 53, and this insulator 53 is press-fit into the tubular ground member 52.

This plug 50 is provided to a cable 54 for high-speed transmission (FIG. 2). The high-speed transmission cable 54, which is a coaxial cable, includes copper core wire serving as a signal line, a resin insulator, a shield line formed of braided wire, and a resin protection film, which are coaxially stacked in layers successively from the center position. The core wire of the cable 54 is connected to the plug pin 51, and the shield line of the cable 54 is connected to the ground member 52.

As illustrated in FIG. 2 and FIG. 5, this plug 50 is inserted into and attached to the corresponding attachment hole 22 to be connected to the connector 10. FIG. 5 illustrates a state where the plug 50 is inserted into and attached to the left attachment hole 22 and no plug is attached to the right attachment hole 22 of the connector 10.

As illustrated in FIG. 5, with the plug 50 being attached to the connector 10 (which state is hereinafter referred to as "attached state"), the plug pin 51 of the plug 50 is connected to the corresponding signal contact 30 of the connector 10. Further, in the attached state, the ground member 52 of the plug 50 is connected to the corresponding ground contact 40 of the connector 10.

Next, a description is given of the signal contact 30. The signal contact 30 is connected to the plug pin 51 when the plug 50 is connected to the connector 10. The plug pin 51 is connected to the signal line (core wire) of the cable 54, so that a signal transmitted through the cable 54 is transmitted to the signal contact 30 through the plug pin 51.

Figure 6:
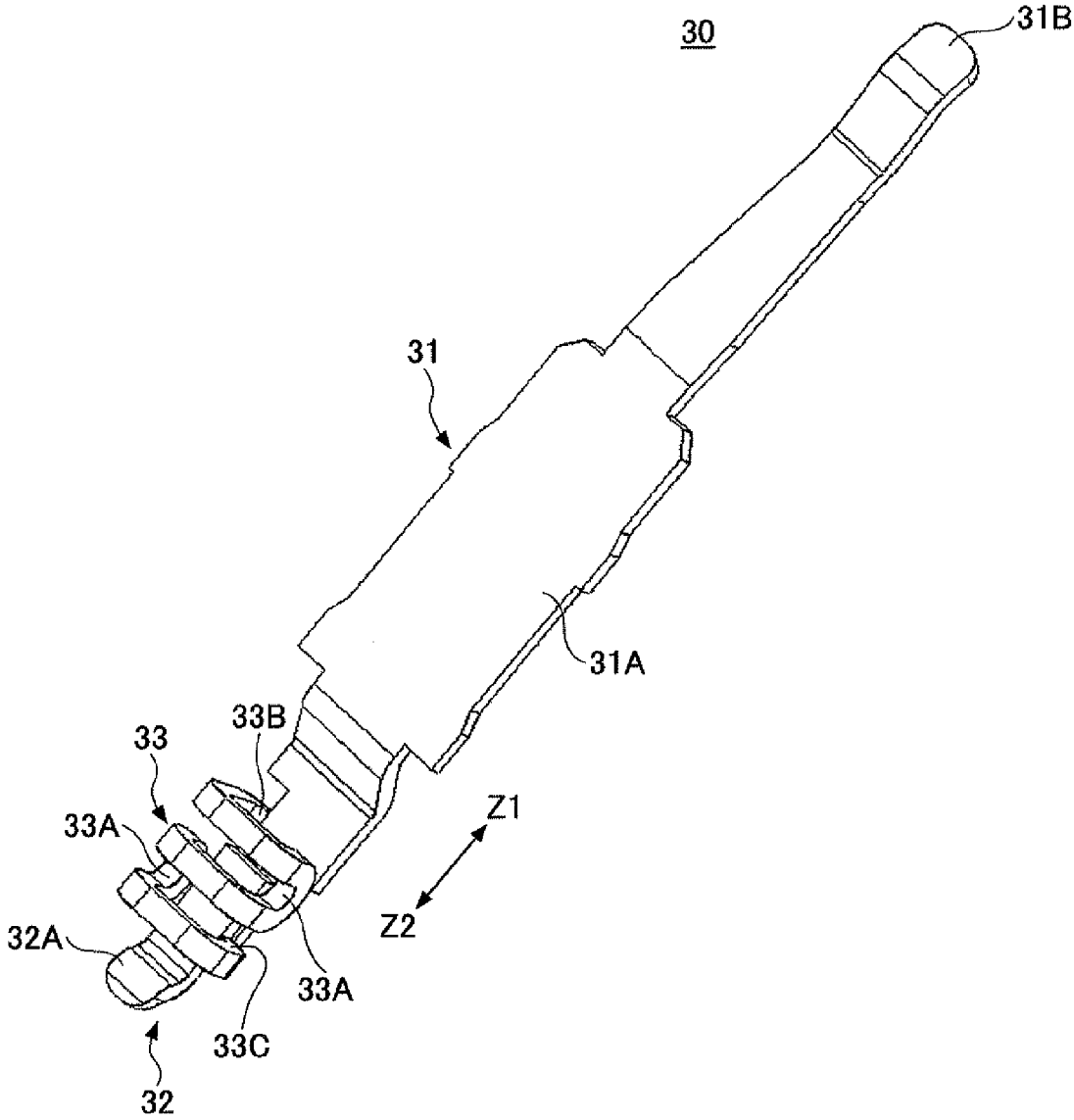
FIG. 6 is a perspective view of a signal contact according to the first embodiment of the present invention.

FIG. 6 is an enlarged perspective view of the signal contact 30. The signal contact 30, which is formed of a contact material such as phosphor bronze, includes a first signal contact part 31, a second signal contact part 32, and a third signal contact part 33, which are formed into a unitary structure. The first signal contact part 31 may be a first contact part. The second signal contact part 32 may be a second contact part. The third signal contact part 33 may be a third contact part.

Figure 7A:
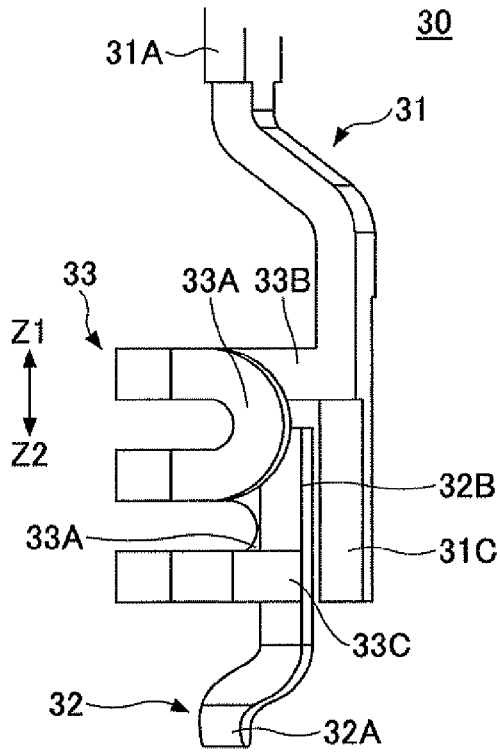
FIGS. 7A and 7B are enlarged views of a third signal contact part and its neighborhood of the signal contact according to the first embodiment of the present invention.
Figure 7B:
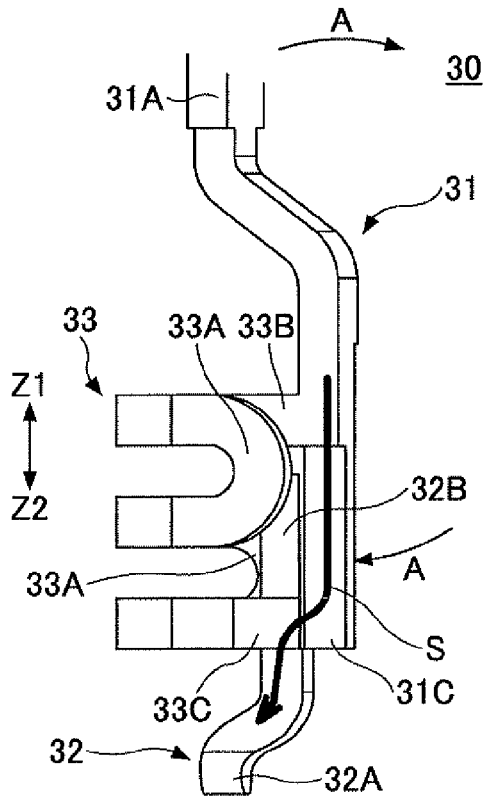

The first signal contact part 31 includes a signal contact body part 31A, a plug signal terminal part 31B, and a first signal connection part 31C (FIGS. 7A and 7B). The plug signal terminal part 31B may be a first terminal part. The first signal connection part 31C may be a first connection part. The signal contact body part 31A is press-fit into a contact holding part 21*a* (FIG. 5) formed inside the corresponding attachment hole 22 provided in the connector housing 20. The signal contact body part 31A is press-fit into the contact holding part 21*a* so that the signal contact 30 is held by the connector housing 20.

Further, the first signal contact part 31 has the plug signal terminal part 31B provided at the upper end of the signal contact body part 31A. The plug signal terminal part 31B is connected to the plug pin 51 when the plug 50 is attached to the connector 10. Further, the first signal contact part 31 has the first signal connection part 31C provided at the lower end of the signal contact body part 31A.

Throughout the specification, the term "upper" refers to the side from which the plug 50 is inserted (the Z1 side in the drawings), and the term "lower" refers to the side opposite to the "upper" side (the Z2 side in the drawings).

Referring to FIGS. 7A and 7B as well as FIG. 6, the second signal contact part 32 has a substantially linear shape. The second signal contact part 32 has a board signal terminal part 32A at its lower end and has a second signal connection part 32B at its upper end. The board signal terminal part 32A may be a second terminal part. The second signal connection part 32B may be a second connection part.

The board signal terminal part 32A is connected to a corresponding one of signal terminals 61 formed on the substrate 60 with the connector 10 mounted on the substrate 60. In this case, the board signal terminal part 32A is not soldered but is in press contact with the corresponding signal terminal 61 to be electrically connected to the signal terminal 61 (of which a description is given below). Further, the board signal terminal part 32A is bent so as to establish good connection to the signal terminal 61.

On the other hand, referring to FIG. 7A, the second signal connection part 32B is configured to face the first signal connection part 31C of the first signal contact part 31 across a gap or space between them with the plug 50 being not attached to the connector 10. As described below, when the plug 50 is attached to the connector 10 or the connector 10 is mounted on the board 60, the first signal connection part 31C and the second signal connection part 32B are electrically connected.

The third signal contact part 33 includes an elastic deformation part 33A, an upper end part 33B, and a lower end part 33C. The elastic deformation part 33A is elastically deformable. The upper end part 33B and the first signal contact part 31 are connected in a unitary structure. The lower end part 33C and the second signal contact part 32 are connected in a unitary structure. The signal contact 30 is formed by working a plate material serving as a base material by press blanking and further bending the plate material into a predetermined shape as illustrated. The elastic deformation part 33A is formed by bending a corresponding U-shaped portion of the blanked-out plate material so as to be substantially U-shaped when viewed along the Z-axis (the Z1 and the Z2 direction) as well.

The third signal contact part 33 is elastically deformable as described above so as to allow the second signal contact part 32 to be displaceable in the Z1 and the Z2 direction relative to the first signal contact part 31 in FIG. 6. Further, the elastic deformation of the third signal contact part 33 generates an elastic restoring force in the third signal contact part 33.

Upward displacement of the second signal contact part 32 (in the Z1 direction) relative to the first signal contact part 31 generates an elastic force (elastic restoring force) to urge the second signal contact part 32 in the downward (Z2) direction in the elastic deformation part 33A. This elastic force serves as a force to bring the board signal terminal part 32A into press contact with the board 60 when the connector 10 is mounted on the board 60.

On the other hand, as shown enlarged in FIGS. 7A and 7B, the first signal connection part 31C of the first signal contact part 31 extends in the Z2 direction from the position of connection of the upper end part 33B of the third signal contact part 33 and the first signal contact part 31. Further, with no external force applied, the third signal contact part 33 keeps the first signal connection part 31C and the second signal connection part 32B of the second signal contact part 32 facing each other across a narrow gap (or in proximity to each other).

Therefore, if the plug 50 is attached to the connector 10 so as to cause the plug pin 51 to come into contact with the signal contact 30 to press and displace the plug signal terminal part 31B in the direction indicated by arrow A (or the clockwise direction) in FIG. 7B, the first signal contact part 31 is rotationally displaced, centered on the position of connection with the upper end part 33B of the third signal contact part 33. Therefore, the first signal connection part 31C is displaced in the direction indicated by arrow A in FIG. 7B with the elastic deformation of the third signal contact part 33. As a result, the first signal connection part 31C comes into contact with the second signal connection part 32B so as to establish electrical connection between them.

When the first signal connection part 31C and the second signal connection part 32B are thus connected electrically, there are two possible signal transmission routes formed between the first signal contact part 31 and the second signal contact part 32: one is through the third signal contact part 33 and the other is through the position of connection of the first signal connection part 31C and the second signal connection part 32B.

In this case, since signals have the characteristic of being transmitted through a shorter route, a signal is transmitted through the route passing through the position of connection of the first signal connection part 31C and the second signal connection part 32B as indicated by a bold solid arrow in FIG. 7B, which illustrates the case of transmitting a signal from the first signal contact part 31 to the second signal contact part 32. Thus, according to this embodiment, compared with the case of transmitting a signal through the third signal contact part 33, it is possible to reduce signal transmission distance so that it is possible to prevent the occurrence of transmission loss in the signal contact 30.

Next, a description is given of the ground contact 40. The ground contact 40 is connected to the ground member 52 when the plug 50 is attached to the connector 10. The ground member 52 is connected to the shield line of the cable 54, and the ground contact 40 is connected to corresponding ground terminal 62 (FIG. 5) of the board 60. Therefore, the ground contact 40 and the ground member 52 are at ground potential. This prevents entry of a disturbance into the plug pin 51 and the signal contact 30 at the position of connection of the connector 10 and the plug 50.

Figure 8:
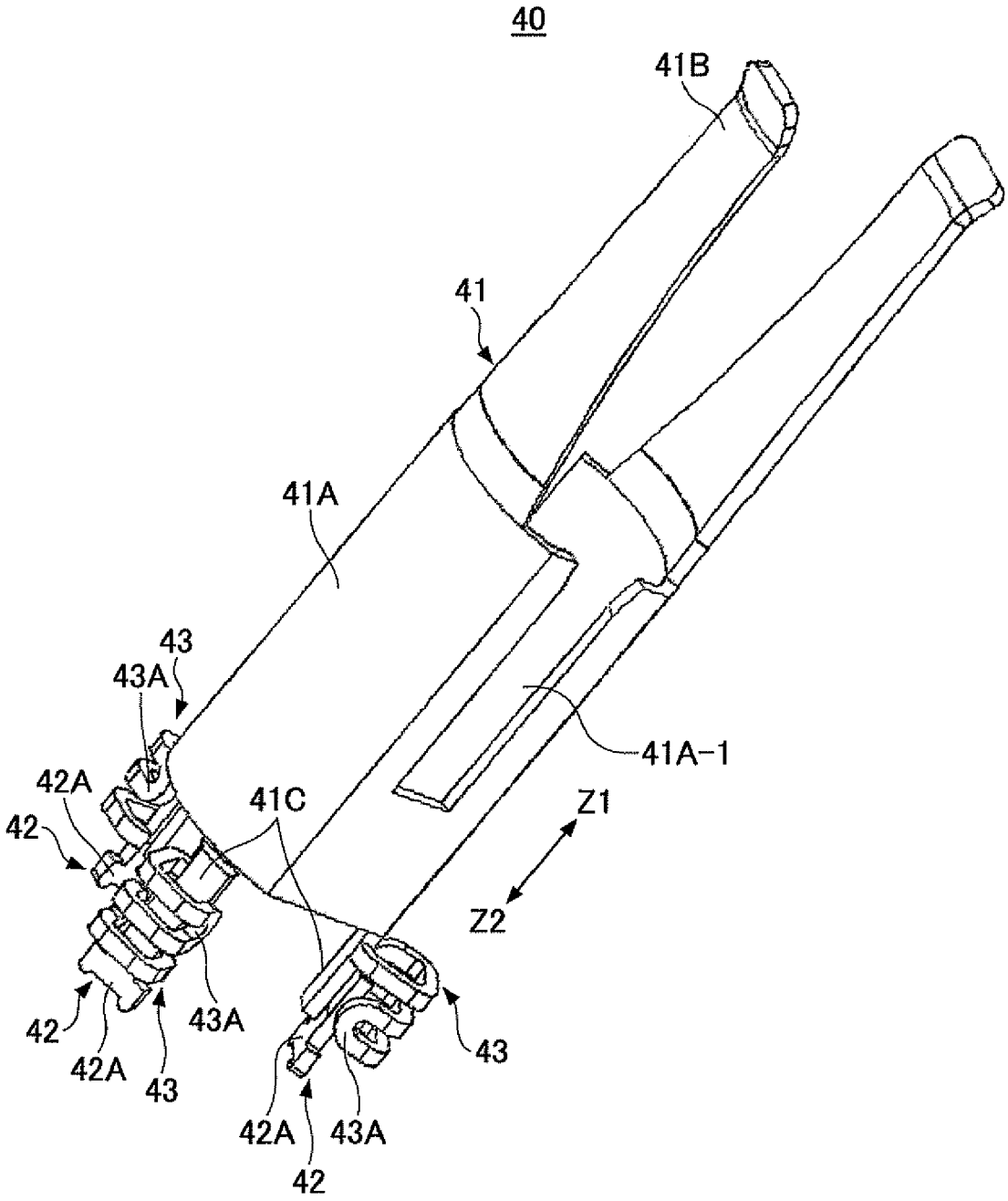
FIG. 8 is a perspective view of a ground contact according to the first embodiment of the present invention.

FIG. 8 is an enlarged view of the ground contact 40. The ground contact 40, which is formed of a contact material such as phosphor bronze, includes a first ground contact part 41, second ground contact parts 42, and third ground contact parts 43, which are formed into a unitary structure. The first ground contact part 41 may be a first contact part. The second ground contact parts 42 may be a second contact part. The third ground contact parts 43 may be a third contact part.

The first ground contact part 41 includes a ground contact body part 41A, a pair of plug ground terminal parts 41B, and first ground connection parts 41C. The plug ground terminal parts 41B may be a first terminal part. The first ground connection parts 41C may be a first connection part. The ground contact body part 41A is press-fit into the corresponding attachment hole 22 provided in the connector housing 20. The ground contact body part 41A is press-fit into the attachment hole 22 so that the ground contact 40 is held by the connector housing 20.

The ground contact body part 41A has a substantially tubular or cylindrical shape. The plug ground terminal parts 41B extend from the upper end of the ground contact body part 41A. The plug ground terminal parts 41B are connected to the ground member 52 of the plug 50 when the plug 50 is inserted into the connector 10. Further, the first ground connection parts 41C are formed at the lower end of the ground contact body part 41A so as to extend linearly in the downward (Z2) direction. (See also FIG. 9.)

Further, slits 41A-1 are formed in the ground contact body part 41A so as to be open between the plug ground terminal parts 41B at the upper end of the ground contact body part 41A. A support part (not graphically illustrated) to support the above-described contact holding part 21*a* (FIG. 5) is inserted into the slits 41A-1. This support part is formed as part of the connector housing 20 with one end of the support part joined to the contact holding part 21*a* and the other end of the support part joined to the internal wall of the attachment hole 22. As a result, the contact holding part 21*a* is supported at the substantial center of the attachment hole 22. Thus, providing the slits 41A-1 in the ground contact 40 makes it possible for the ground contact 40 to be inserted into and attached at the attachment hole 22 with the support part formed inside.

Figure 9:
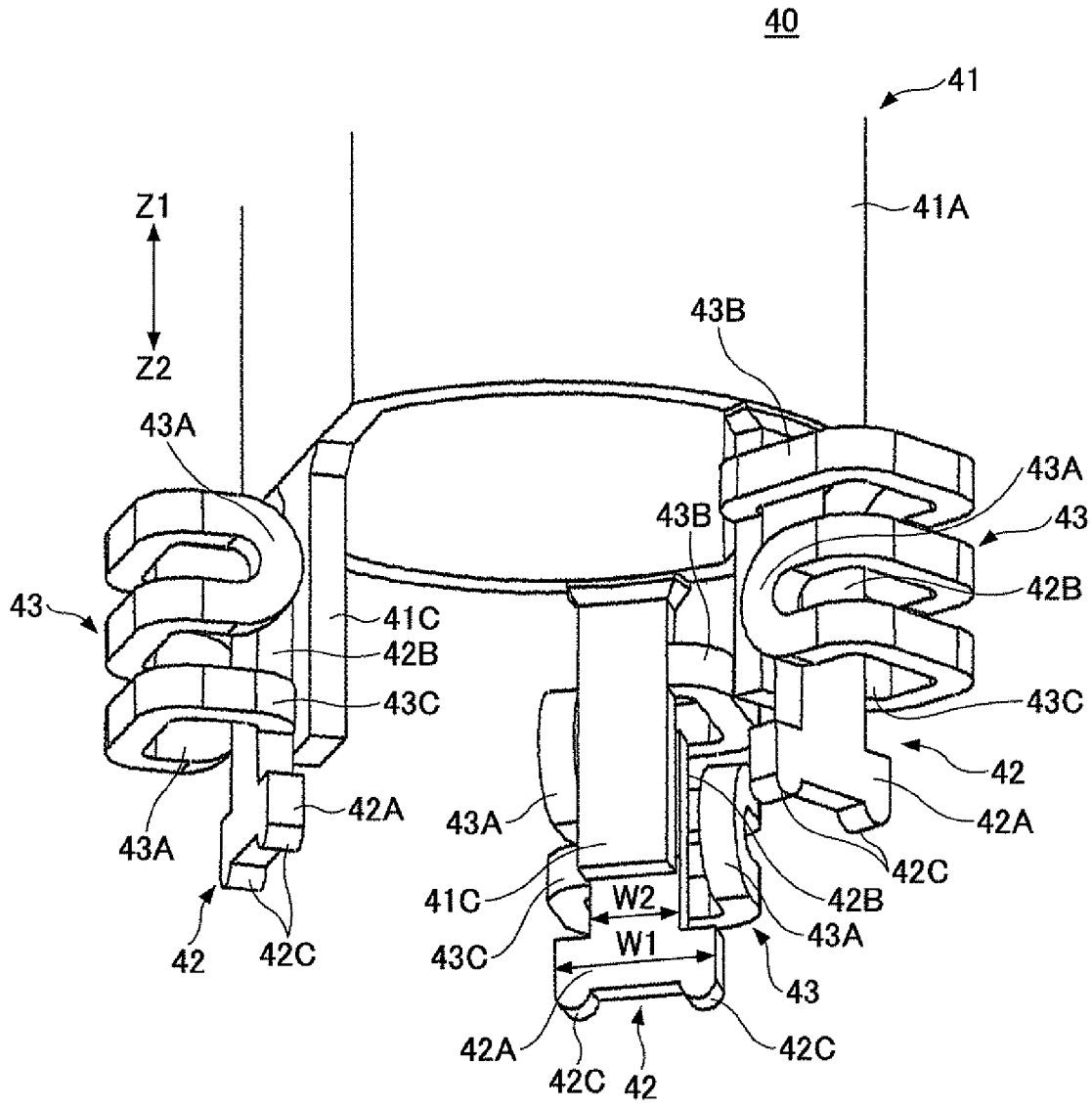
FIG. 9 is an enlarged perspective view of third ground contact parts and their neighborhood of the ground contact according to the first embodiment of the present invention.

Referring to FIG. 9 as well as FIG. 8, each second ground contact part 42 has an inverse T-letter shape. The second ground contact part 42 includes a board ground terminal part 42A in its lower portion and a second ground connection part 42B in its upper portion. The board ground terminal part 42A may be a second terminal part. The second ground connection part 42B may be a second connection part.

The board ground terminal part 42A is connected to a corresponding one of the ground terminals 62 formed on the board 60 with the connector 10 mounted on the board 60. In this case, the board ground terminal part 42A is not soldered but is in press contact with the corresponding ground terminal 62 to be electrically connected to the ground terminal 62 (of which a description is given below).

Further, according to this embodiment, multiple, for example, three second ground contact parts 42 are provided for each first ground contact part 41. In a bottom view of the ground contact 40, the three second ground contact parts 42 are provided at intervals of 120 degrees, so that the ground connection parts 41C are also provided at intervals of 120 degrees at the lower end of the ground contact body part 41A in a bottom view of the ground contact 40.

Further, as indicated by double-headed arrows in FIG. 9, for good electrical connection between the second ground contact parts 42 and the corresponding ground terminal 62, the board ground terminal part 42A has a width W1 greater than a width W2 of the second ground connection part 42B in each second ground contact part 42. As a result of this configuration, the second ground contact parts 42 have an inverse T-letter shape as described above. Further, each board ground terminal part 42A is provided with a connection projection 42C projecting downward (in a direction to face the corresponding ground terminal 62 or the Z2 direction) from the board ground terminal part 42A.

According to the above-described configuration of the second ground contact parts 42, even if the board ground terminal parts 42A are inclined relative to the ground terminal 62 in the contact, at least one of the second ground contact parts 42 and at least one of the connection projections 42C are connected to the corresponding ground terminal 62 without fail, so that it is possible to ensure electrical connection between the ground contacts 40 and the board 60.

Implementation of one or more of providing each first ground contact part 41 with multiple second ground contact parts 42, making the width W1 of the board ground terminal part 42A greater than the width W2 of the second ground connection part 42B, and providing the board ground terminal part 42A with the connection projections 42C improves the connection between the ground contacts 40 and the board 60.

On the other hand, the second ground connection part 42B is configured to face the first ground connection part 41C formed in the corresponding first ground contact part 41 across a gap or space between them with the plug 50 being not attached to the connector 10. As described below, when the plug 50 is attached to the connector 10 or the connector 10 is mounted on the board 60, the first ground connection part 41C and the second ground connection part 42B are electrically connected.

Each third ground contact part 43 has substantially the same configuration as the above-described third signal contact part 33. The third ground contact part 43 includes an elastic deformation part 43A, an upper end part 43B, and a lower end part 43C. The elastic deformation part 43A is elastically deformable. The upper end part 43B and the first ground contact part 41 (the corresponding first ground connection part 41C) are connected in a unitary structure. The lower end part 43C and the second ground contact part 42 are connected in a unitary structure. The third ground contact part 43 is elastically deformable so as to allow the second ground contact part 42 to be displaceable in the Z1 and the Z2 direction relative to the first ground contact part 41 in FIG. 9. Further, the elastic deformation of the third ground contact part 43 generates an elastic restoring force in the third ground contact part 43.

Upward displacement of the second ground contact part 42 (in the Z1 direction) relative to the first ground contact part 41 generates an elastic force (elastic restoring force) to urge the second ground contact part 42 in the downward (Z2) direction in the elastic deformation part 43A. This elastic force serves as a force to bring the board ground terminal part 42A into press contact with the board 60 when the connector 10 is mounted on the board 60.

On the other hand, as shown enlarged in FIG. 9, the first ground connection part 41C of the first ground contact part 41 extends in the Z2 direction from the position of connection of the upper end part 43B of the third ground contact part 43 and the first ground contact part 41. Further, with no external force applied, the third ground contact part 43 keeps the first ground connection part 41C and the second ground connection part 42B of the second ground contact part 42 facing each other across a narrow gap (or in proximity to each other).

Therefore, if the plug 50 is attached to the connector 10 so as to cause the ground member 52 to come into contact with the ground contact 40 so that the ground contact 40 is pressed and displaced, the first ground connection parts 41C are also displaced to come into contact with the corresponding second ground connection parts 42B. Thereby, the first ground connection parts 41C and the second ground connection parts 42B are electrically connected.

Next, a description is given of the board 60 on which the connector 10 having the above-described configuration is mounted.

Figure 10:
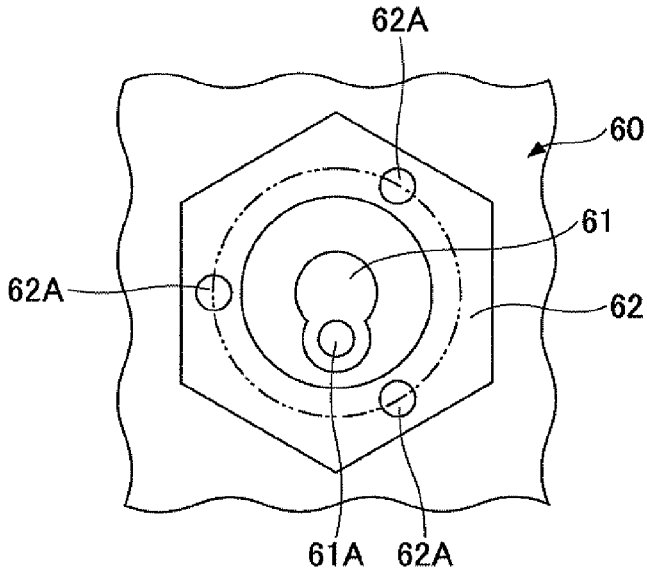
FIG. 10 is an enlarged view of a pair of a signal terminal and a ground terminal formed on a board according to the first embodiment of the present invention.
Figure 11:
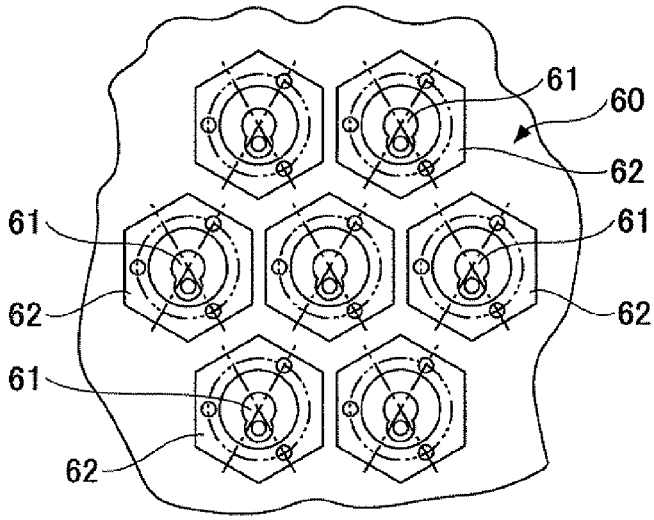
FIG. 11 is an enlarged view of signal terminals and ground terminals formed on the board according to the first embodiment of the present invention.

The board 60, which is a multilayer printed wiring board, has the signal terminals 61 and the ground terminals 62 provided on its surface. FIG. 10 and FIG. 11 illustrate a structure of the signal terminals 61 and the ground terminals 62. FIG. 10 illustrates a signal terminal 61 and a corresponding ground terminal 62 corresponding to a pair of a signal and a ground contact 30 and 40. FIG. 11 illustrates multiple signal and ground terminals 61 and 62 provided on the board 60.

Figure 12:
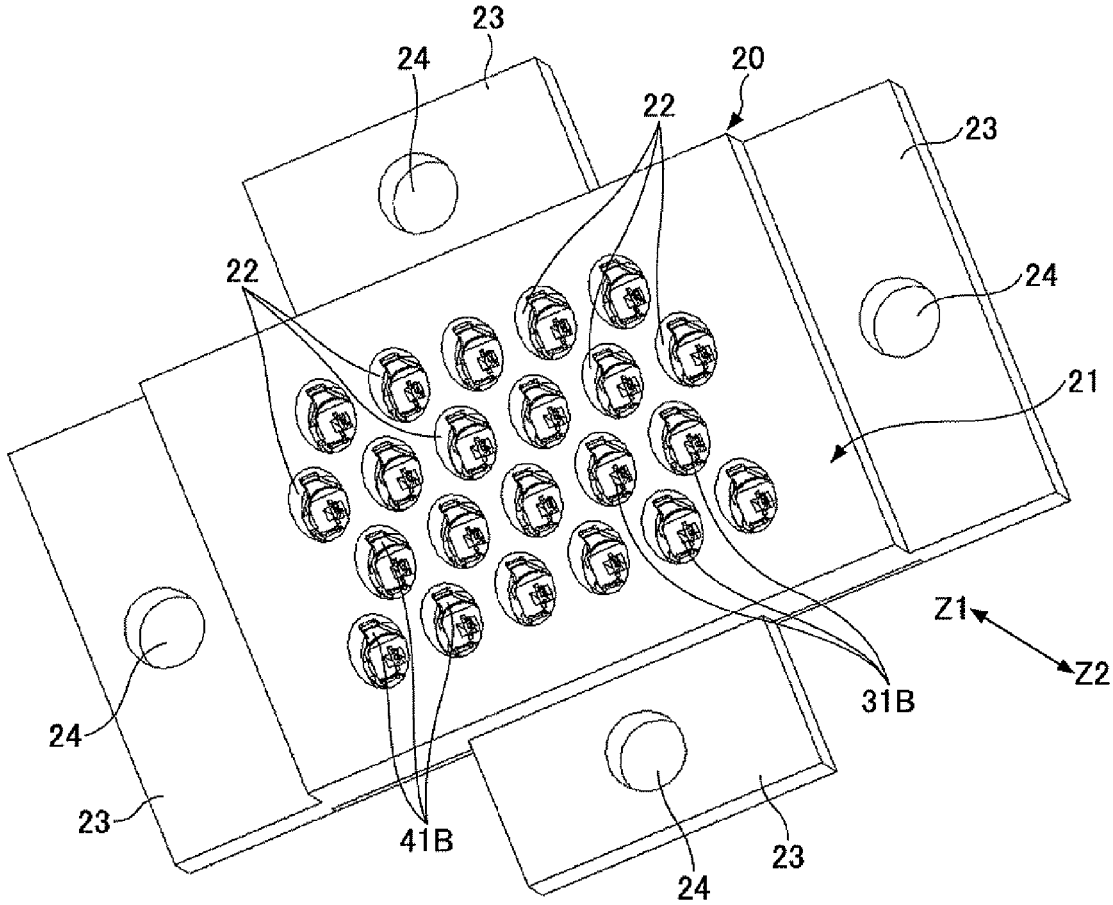
FIG. 12 is a top-side perspective view of the connector according to the first embodiment of the present invention.

FIG. 12 is a top-side perspective view of the connector 10. Referring to FIG. 12 as well as FIG. 1 and FIG. 5, one signal contact 30 and one ground contact 40 are attached in a pair to each attachment hole 22 of the connector housing 20. Accordingly, in correspondence to the contacts 30 and 40 attached at each attachment hole 22, a signal terminal 61 corresponding to the signal contact 30 and a ground terminal 62 corresponding to the ground contact 40 are formed in a pair on the board 60.

Referring to FIG. 10, the ground terminal 62 has an annular shape corresponding to the tubular shape of the ground contact body part 41A of the first ground contact part 41. The ground terminal 62 is shaped like a hexagonal nut to have a hexagonal outer shape with a circular hole inside. The signal terminal 61 is formed at the center position of the region inside the ground terminal 62. The signal terminal 61 and the ground terminal 62 include a via connection part 61A and via connection parts 62A, respectively, which are electrically connected to corresponding vias formed in the board 60. Thereby, the terminals 61 and 62 are electrically connected to internal layer interconnects (not graphically illustrated) formed in the board 60.

Positioning holes 63 (FIG. 5) into which the corresponding projections 26 for positioning the connector 10 are inserted and insertion holes (not graphically illustrated) into which fixation screws for fixing the connector 10 to the board 60 are inserted are provided in the board 60.

Next, a description is given of a method of assembling the connector 10 having the above-described configuration and a method of mounting the assembled connector 10 on the board 60.

Before assembling the connector 10, the connector housing 20, the signal contacts 30, the ground contacts 40, and the bottom plate 29, manufactured in advance in separate processes to be shaped as described above, are prepared. Then, the signal contacts 30 and the ground contacts 40 are inserted into and attached to the corresponding attachment holes 22 from the bottom side of the connector housing 20. At this point, as described above, the signal contacts 30 are attached to the corresponding contact holding parts 21*a*, and the ground contacts 40 are press-fit into the corresponding attachment holes 22.

FIG. 4 and FIG. 12 are a bottom-side perspective view and a top-side perspective view, respectively of the connector housing 20 where a signal contact 30 and a ground contact 40 are attached at each of the attachment holes 22 formed in the connector housing 20.

As illustrated in FIG. 4, the step part 25 is formed in the connector housing 20 on its bottom side, and the positioning projections 26 and the screw holes 27 are formed in the step part 25. The board signal terminal parts 32A of the signal contacts 30 and the board ground terminal parts 42A of the ground contacts 40 project from (the bottom surface part of) the step part 25 with the contacts 30 and 40 attached to the connector housing 20.

After the contacts 30 and 40 are attached to the connector housing 20 as described above, the bottom plate 29 is attached to the step part 25. The bottom plate 29 has through holes formed at positions corresponding to the positioning projections 26 and positions opposed to the screw holes 27. The bottom plate 29 further includes terminal holes 29A (FIG. 3) formed at positions corresponding to the board signal terminal parts 32A and the board ground terminal parts 42A. Screws 28 are screwed into the screw holes 27 through the corresponding through holes of the bottom plate 29 attached to the step part 25, so that the bottom plate 29 is fixed to the connector housing 20.

Figure 13:
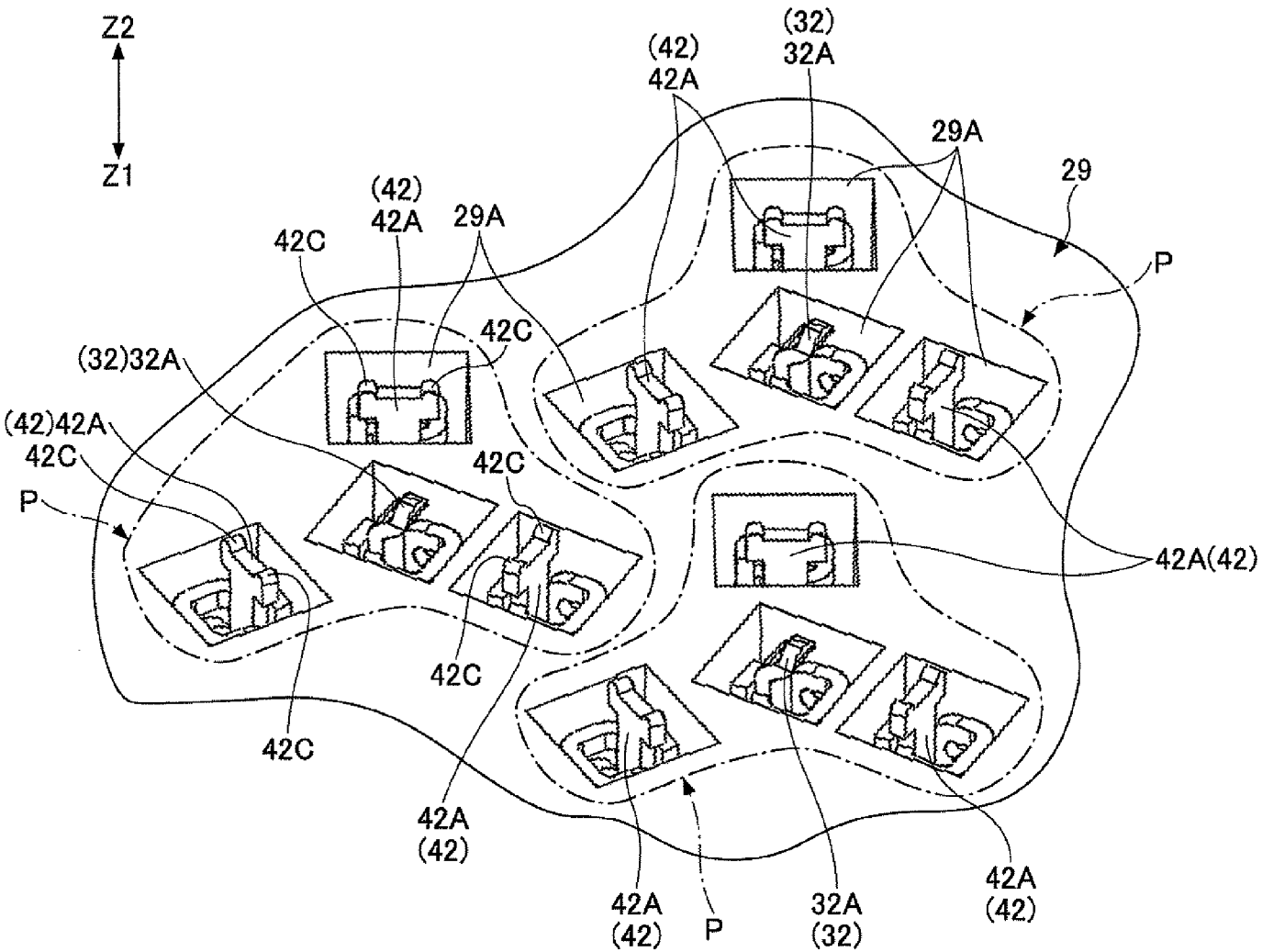
FIG. 13 is an enlarged perspective view of part of the bottom plate of a connector housing according to the first embodiment of the present invention.

At this point, the board signal terminal parts 32A and the board ground terminal parts 42A project from the bottom plate 29 fixed to the step part 25 as well. FIG. 13 is an enlarged view of part of the bottom plate 29, illustrating positions where terminal holes 29A are formed. As illustrated in FIG. 13, the board signal terminal parts 32A and the board ground terminal parts 42A project in the downward (Z2) direction from the bottom plate 29 through the corresponding terminal holes 29A.

Further, the terminal parts 32A and 42A are not fixed but loosely fit in the terminal holes 29A so as to be displaceable (movable) in the terminal holes 29A. The positioning projections 26 also project from the bottom plate 29 fixed to the step part 25.

As described above, the contacts 30 and 40 are attached to the connector housing 20 by simply inserting them into the corresponding attachment holes 22. This facilitates manufacturing of the connector 10. Further, attachment of the bottom plate 29 to the connector housing 20 prevents removal of the contacts 30 and 40. This increases the reliability of the connector 10.

Next, a description is given of a method of mounting the connector 10 on the board 60. In mounting the connector 10 on the board 60, first, the positioning projections 26 are inserted into the positioning holes 63 formed in the board 60 so as to position the connector 10 relative to the board 60. (See, for example, FIG. 5.) In this state, the board signal terminal parts 32A and the board ground terminal parts 42A projecting from the bottom plate 29 are positioned relative to the signal terminals 61 and the ground terminals 62, respectively.

Next, fixation screws (not graphically illustrated) are inserted into the insertion holes 24 formed in the flange parts 23 of the connector housing 20, and the connector 10 is fixed to the board 60 using these fixation screws. As a result of screwing (fixing) the connector 10 to the board 60, the board signal terminal parts 32A and the board ground terminal parts 42A projecting from the bottom plate 29 are relatively pressed. As a result, the elastic deformation parts 33A of the third signal contact parts 33 and the elastic deformation parts 43A of the third ground contact parts 43 deform elastically so as to press the board signal terminal parts 32A and the board ground terminal parts 42A against the signal terminals 61 and the ground terminals 62, respectively, with their elastic restoring forces.

Thus, the electrical connection between the signal and the ground contacts 30 and 40 and the board 60 is established by pressing the terminal parts 32A and 42A against the terminals 61 and 62, respectively, with the elastic restoring forces of the elastic deformation parts 33A and 43A. Therefore, even if there is attachment error in attaching the signal contacts 30 and/or the ground contacts 40 to the connector housing 20 or even if the connector housing 20, the signal contacts 30, and/or the ground contacts 40 include manufacturing error, such error is absorbed by the elastic deformation of the elastic deformation parts 33A and/or the elastic deformation parts 43A. Further, since the terminal parts 32A and 42A are pressed against the terminals 61 and 62, respectively, electrical connection is ensured. Therefore, the connection reliability of the connector 10 and the board 60 is increased.

Further, according to this embodiment, the electrical connection between the terminal parts 32A and 42A and the terminals 61 and 62 is established by pressing the terminal parts 32A and 42A against the terminals 61 and 62, respectively, without using soldering, which is a common method of connecting a connector and a board. Accordingly, the connector 10 is removed with ease from the board 60 when it is necessary to remove the connector 10 from the board 60 for purposes such as repairs. Therefore, the repairability of the connector 10 is improved.

Second Embodiment

A description is given of a second embodiment according to the present invention.

Figure 14:
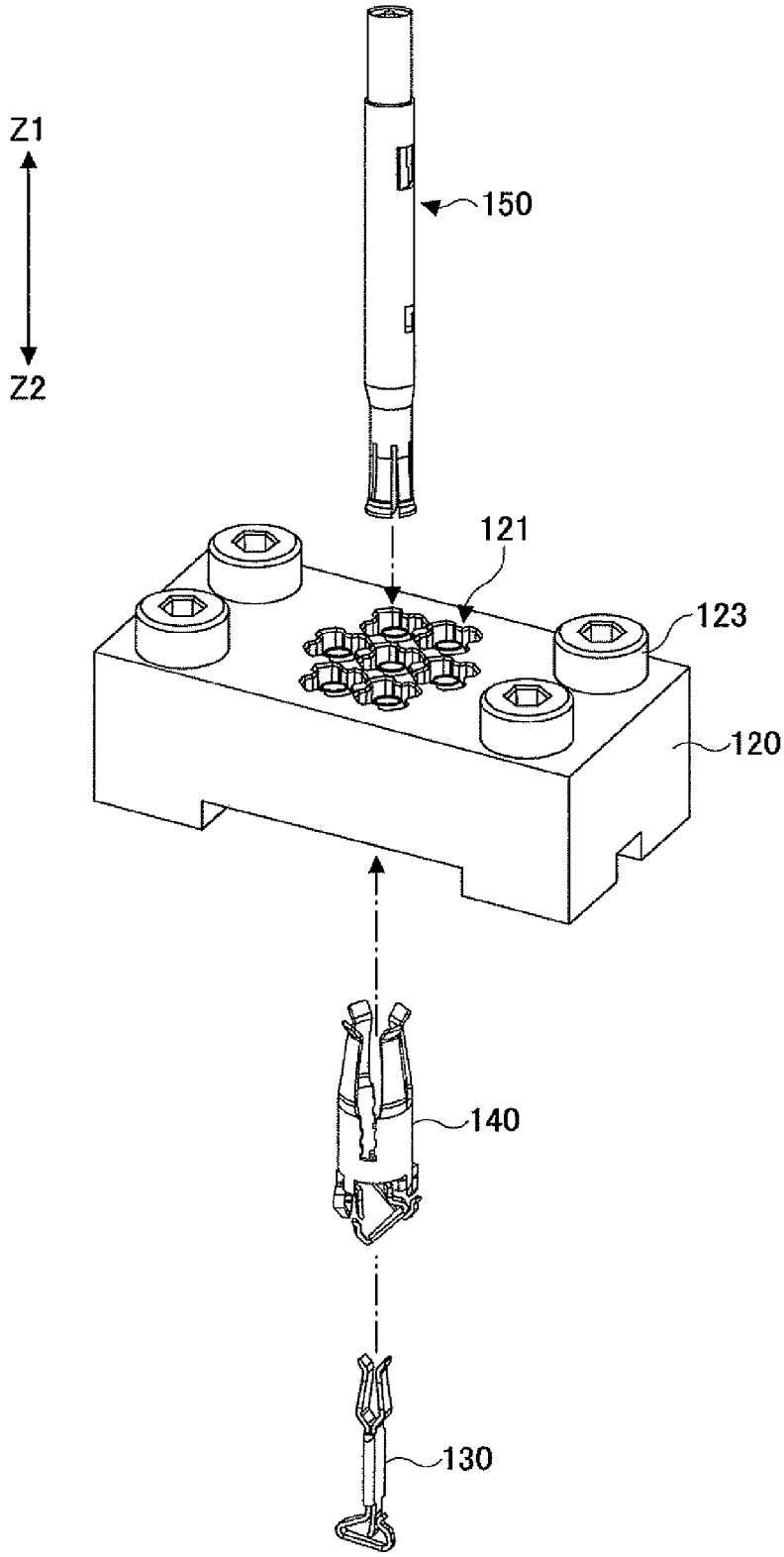
FIG. 14 is an exploded perspective view of a connector according to a second embodiment of the present invention.
Figure 15A:
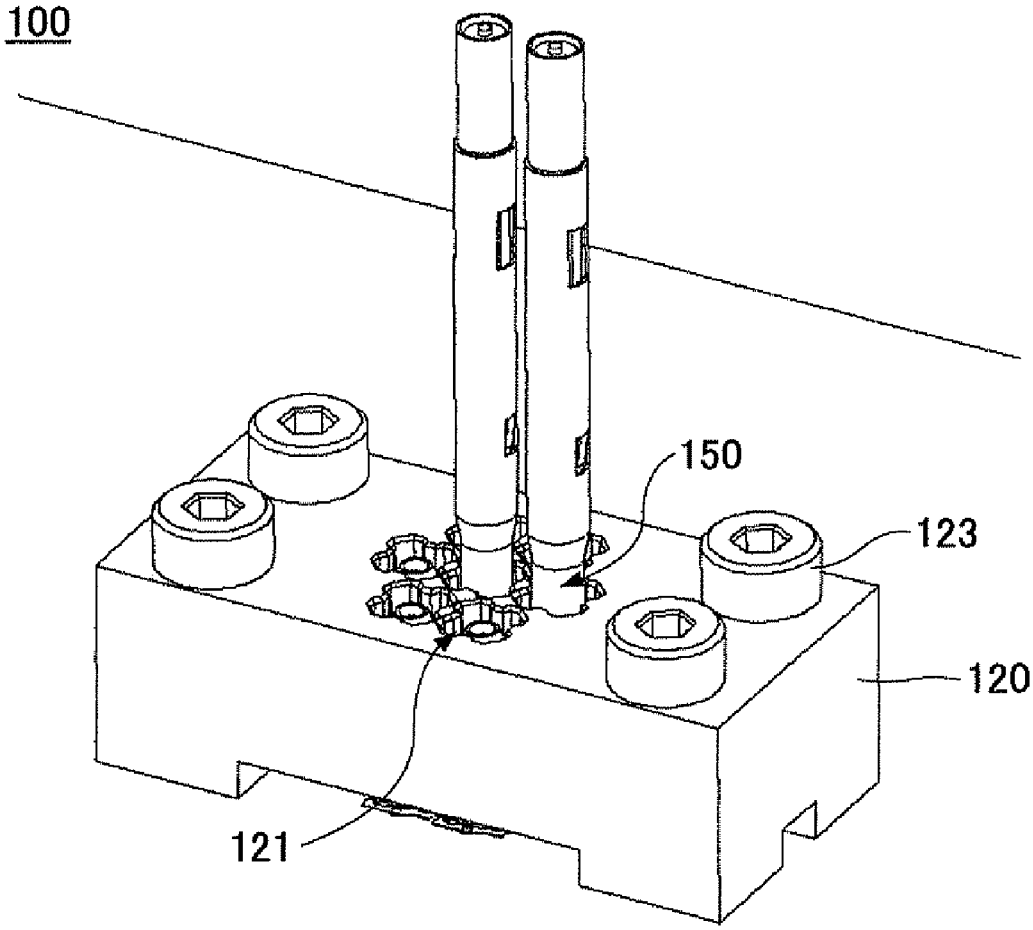
FIGS. 15A and 15B are a top-side perspective view and a bottom-side perspective view, respectively, of the connector, illustrating its exterior, according to the second embodiment of the present invention.
Figure 15B:
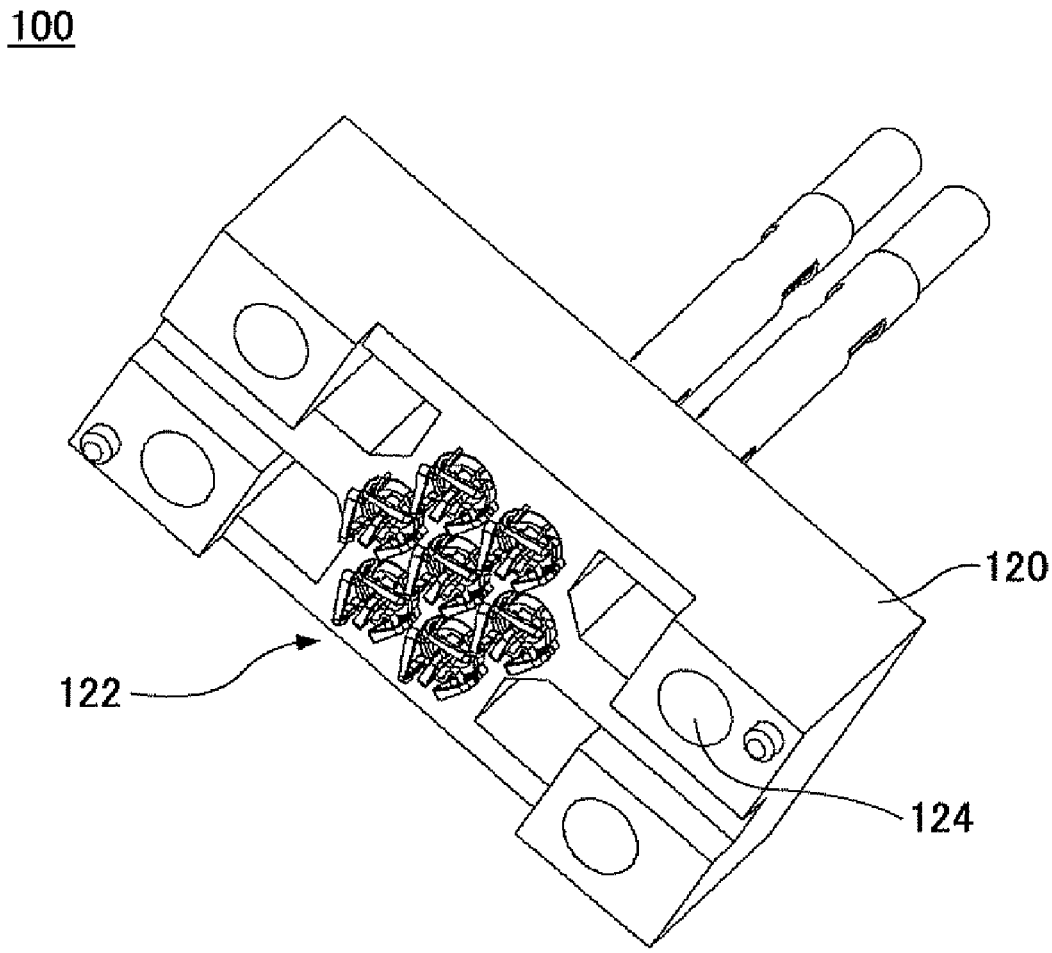

FIG. 14 is an exploded perspective view of a connector 100 according to the second embodiment. FIGS. 15A and 15B are a top-side perspective view and a bottom-side perspective view, respectively, of the connector 100, illustrating its exterior.

Like the connector 10 of the first embodiment, the connector 100 is to be surface-mounted on a board (not graphically illustrated), and electrically connects inserted plugs 150 and the board. The connector 100 includes a connector housing 120, signal contacts 130, and ground contacts 140.

The connector housing 120 is formed by molding thermoplastic resin such as LCP (liquid crystal polymer). Multiple attachment holes 121 at which the signal contacts 130 and the ground contacts 140 are attached to the connector housing 120 are formed through the connector housing 120. Further, insertion holes 124, into which bolts 123 (or screws) are to be inserted that are used at the time of mounting the connector 100 on the board, are formed in the corresponding four corners of the connector housing 120. Further, a step part 122 for attaching the bottom plate 29 (described above in the first embodiment) is formed on the bottom surface of the connector housing 120.

A description is given of the plugs 150 to be attached to the connector 100. The plugs 150 are those to be attached to a high-speed transmission cable such as a coaxial cable.

Figure 16:
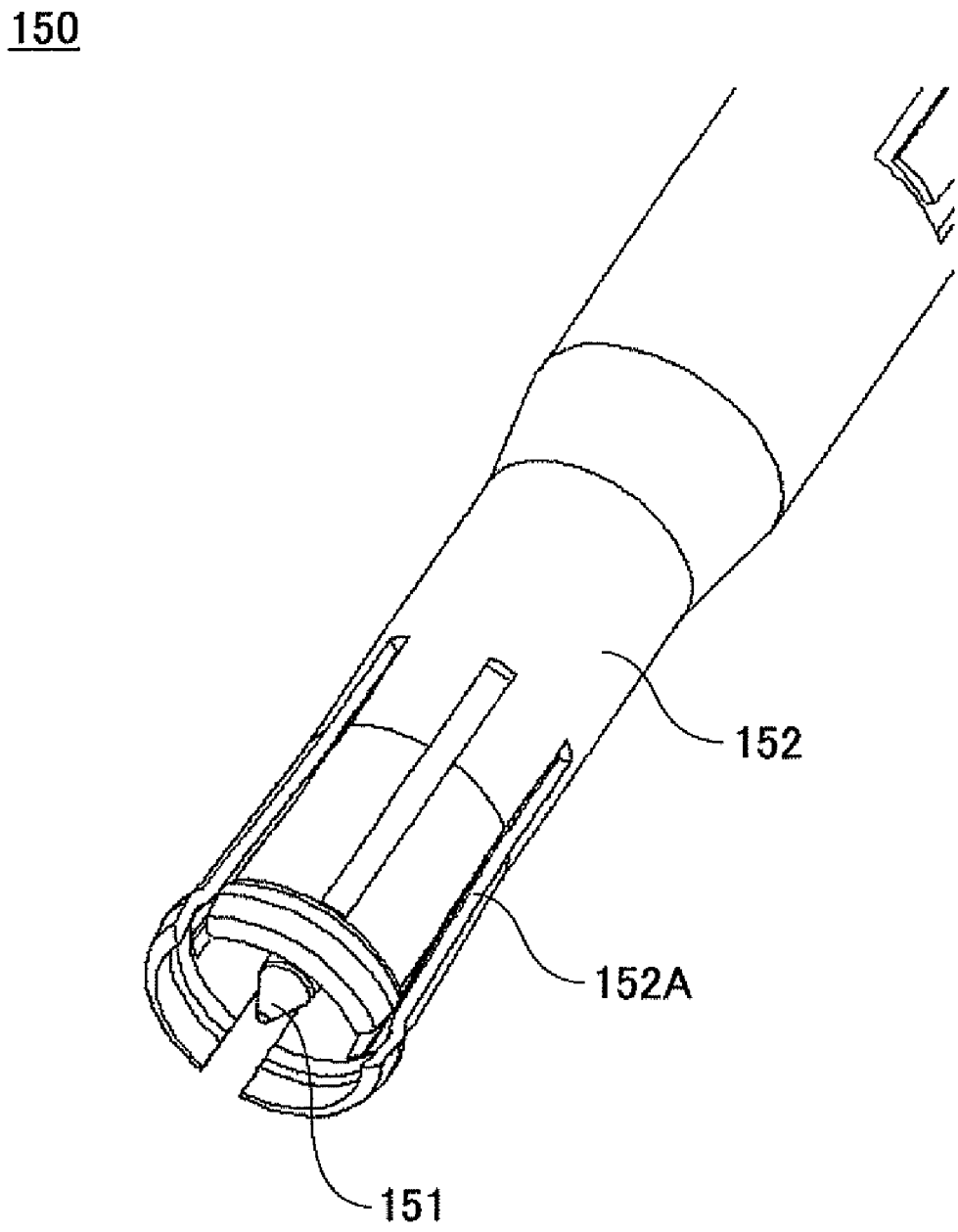
FIG. 16 is a perspective view of a plug according to the second embodiment of the present invention.

FIG. 16 is a perspective view of the plug 150, illustrating its exterior.

Referring to FIG. 16, the plug 150 includes a plug pin 151 and a ground member 152. The core wire and the shield line of a coaxial cable (not graphically illustrated) to which the plug 150 is attached are connected to the plug pin 151 and the ground member 152, respectively.

As illustrated in FIG. 16, the ground member 152 has multiple slits 152A formed from its end toward its base, so that the end of the ground member 152 is divided into multiple portions. This shape allows the ground member 152 to be pressed and elastically deformed toward the plug pin 151 side in response to external pressure.

Figure 17:
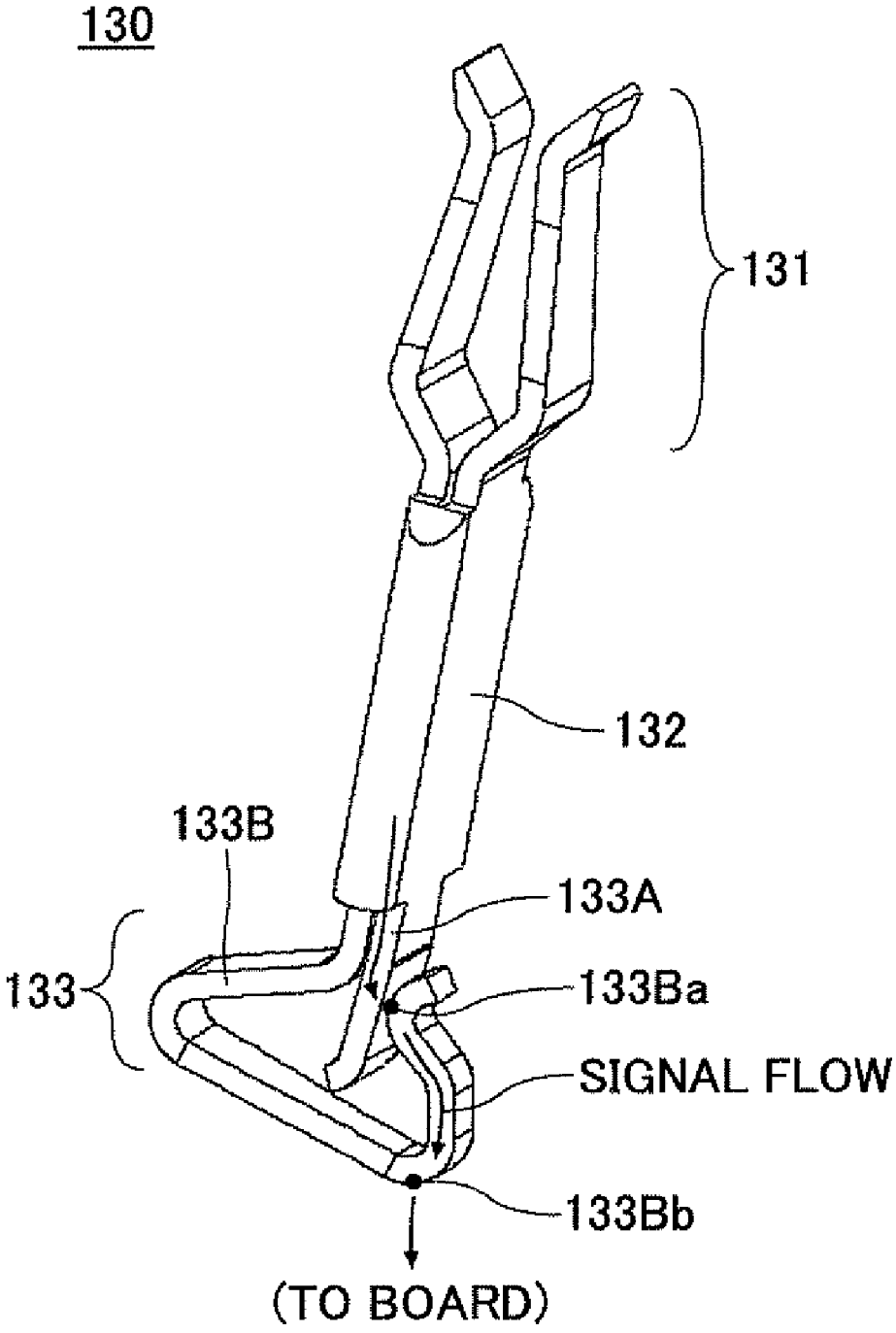
FIG. 17 is a perspective view of a signal contact, illustrating its exterior, according to the second embodiment of the present invention.

FIG. 17 is a perspective view of the signal contact 130, illustrating its exterior.

The signal contact 130, which is formed of a contact material such as phosphor bronze, includes a signal contact first terminal part 131 for connection to the plug pin 51, a signal contact body part 132, and a signal contact second terminal part 133 for connection to the board, which are formed into a unitary structure. The signal contact first terminal part 131 may be a third terminal part. The signal contact second terminal part 133 may be a fourth terminal part.

The signal contact first terminal part 131 establishes electrical connection to the plug pin 151 by holding the plug pin 151 when the plug 150 is attached to the connector 100. The signal contact first terminal part 131 is not limited to this configuration, and may be configured to be electrically connected to the plug pin 151 by coming into press contact with the plug pin 151 from one side. Since the plug pin 151 is connected to the signal line (core wire) of the cable as described above, a signal transmitted through the cable is transmitted to the signal contact 130 through the plug pin 151. A description is given below of the signal contact second terminal part 133.

Figure 18:
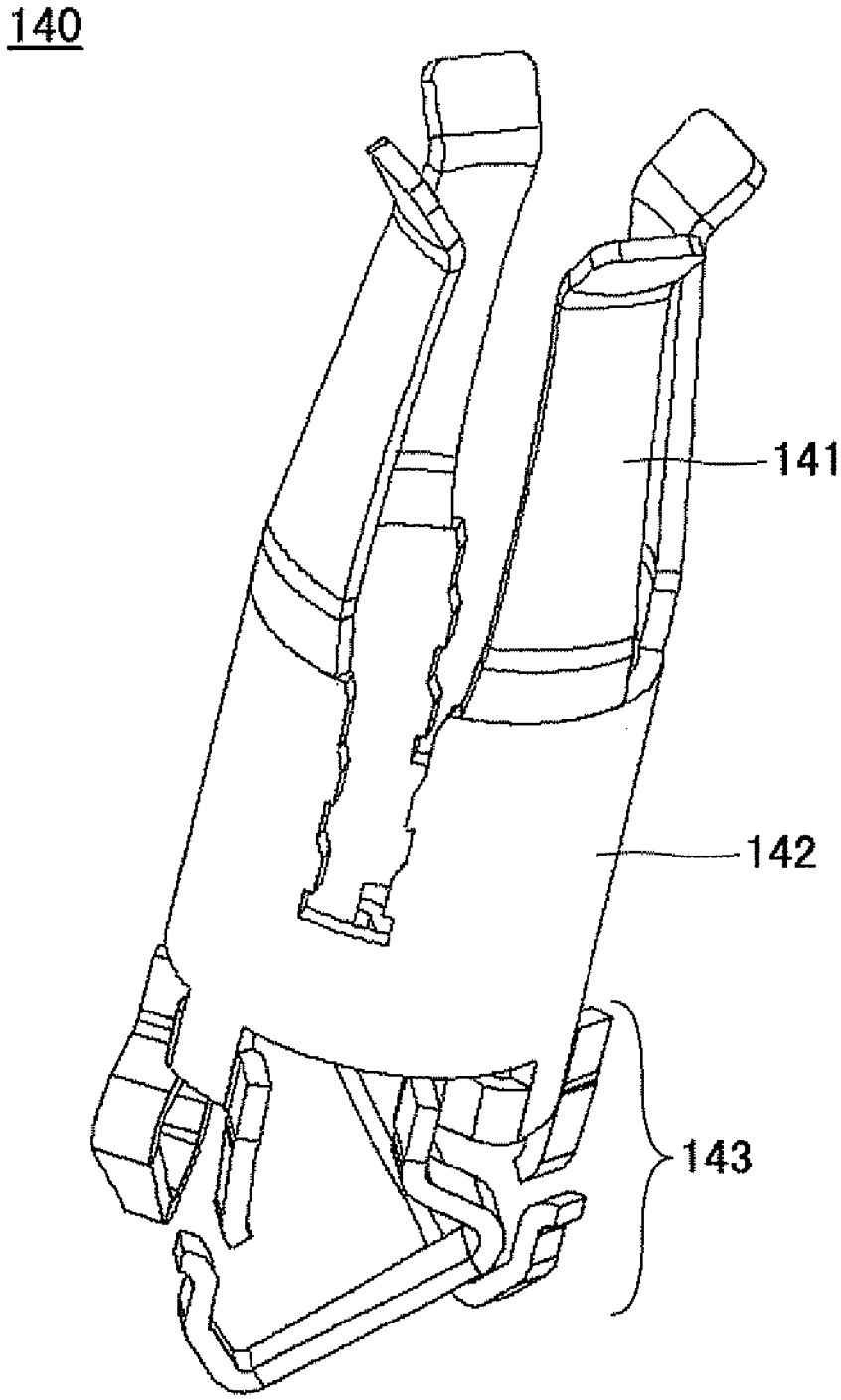
FIG. 18 is a perspective view of a ground contact, illustrating its exterior, according to the second embodiment of the present invention.

FIG. 18 is a perspective view of the ground contact 140, illustrating its exterior.

The ground contact 140, which is formed of a contact material such as phosphor bronze, includes ground contact first terminal parts 141 for connection to the ground member 152, a substantially cylindrical ground contact body part 142, and ground contact second terminal parts 143 for connection to the board, which are formed into a unitary structure. The ground contact first terminal parts 141 may be a first terminal part. The ground contact second terminal parts 143 may be a second terminal part.

Referring to FIG. 18, for example, four ground contact first terminal parts 141 are formed at predetermined circumferential intervals on one end of the ground contact body part 142, and three ground contact second terminal parts 143 are formed at predetermined circumferential intervals (such as 120° angular intervals) on the other end of the ground contact body part 142. Providing three or more ground contact second terminal parts 143 in this manner stabilizes transmission of a ground signal.

When the plug 150 is attached to the connector 100, the ground contact first terminal parts 141 are pressed outward by the ground member 152, and establish electrical connection to the ground member 152 by holding it with the restoring force of the ground contact first terminal parts 141. The ground member 152 is connected to the shield line of the cable, and the ground contact 140 is connected to a ground terminal on the board. Accordingly, the ground contact 140 and the ground member 152 are at ground potential. A description is given below of the ground contact second terminal parts 143.

Like the signal contact 30 of the first embodiment, the signal contact 130 is contained and held inside the ground contact body part 142 of the ground contact 140. A description of this structure is omitted. This structure prevents entry of a disturbance into the plug pin 151 and the signal contact 130 at the position of connection of the connector 100 and the plug 150.

Figure 19:
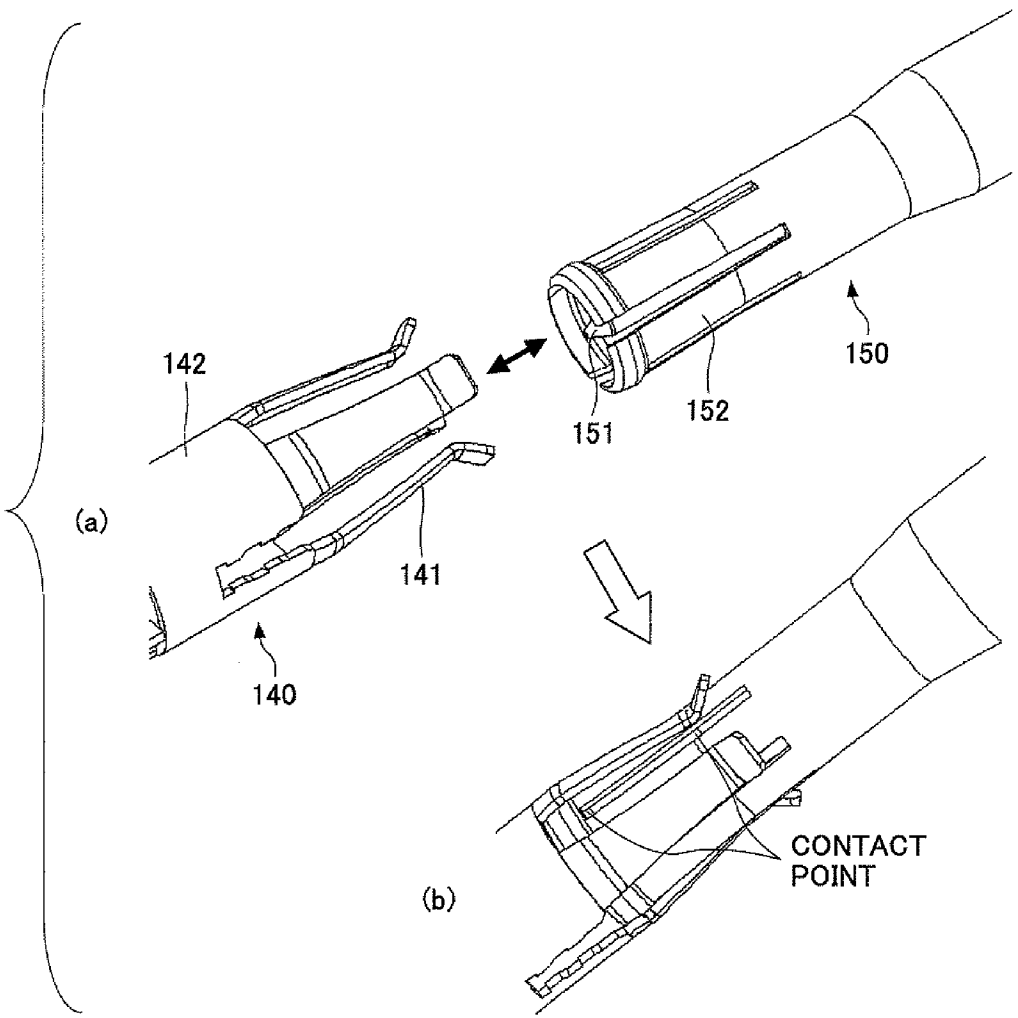
FIG. 19 is a diagram illustrating how the plug is attached to the connector according to the second embodiment of the present invention.

FIG. 19 is a schematic diagram illustrating how the plug 150 is connected to the connector 100.

When the plug 150 is connected to the connector 100, the ground member 152 elastically deforms toward the plug pin 151 side and the ground contact first terminal parts 141 elastically deform outward, so that the plug 150 is stably fixed by their respective restoring forces.

At this point, the connection of the ground contact first terminal parts 141 to the ground member 152 is ensured at two points: one on the entrance side and the other on the base side. This avoids generation of a stub to the ground signal transmission line and prevents entry of noise in high-frequency transmission.

A description is given below of connection of the connector 100 and the board.

In the connector 100 of this embodiment, like in the connector 10 of the first embodiment, contact members elastically deform upon attachment of the connector housing 120 to the board with screws or bolts, so as to come into press contact with corresponding electrodes on the board with their restoring forces, thereby establishing stable electrical connection. Reference may be made to the first embodiment for the board-side electrode structure of this embodiment, and a description thereof is omitted.

Referring to FIG. 17, the signal contact second terminal part 133 includes a signal contact first member 133A and a signal contact second member 133B. The signal contact first member 133A may be a third member. The signal contact second member 133B may be a fourth member.

The signal contact first member 133A extends substantially linearly from the signal contact body part 132 toward the board side.

Further, the signal contact second member 133B, which has a curved shape so that an end part 133Ba thereof faces the signal contact first member 133A across a gap, is elastically deformable. The signal contact first member 133A and the signal contact second member 133B are formed by working a plate material serving as a base material by press blanking and further bending the plate material into a predetermined shape as illustrated.

When the connector 100 is attached to the board with screws or bolts, the signal contact second member 133B elastically deforms so that its end part 133Ba comes into press contact with the signal contact first member 133A. Further, a board-side end part 133Bb of the signal contact second member 133B, which is designed to come into contact with a board-side electrode, comes into press contact with a corresponding board-side electrode with the restoring force of the signal contact second member 133B.

Signals have the characteristic of being transmitted through a shorter route. Therefore, a signal flows to the board through a transmission path from the signal contact first terminal part 131 to the board-side end part 133Bb via the signal contact body part 132, the signal contact first member 133A, and the end part 133Ba of the signal contact second member 133B.

Figure 20:
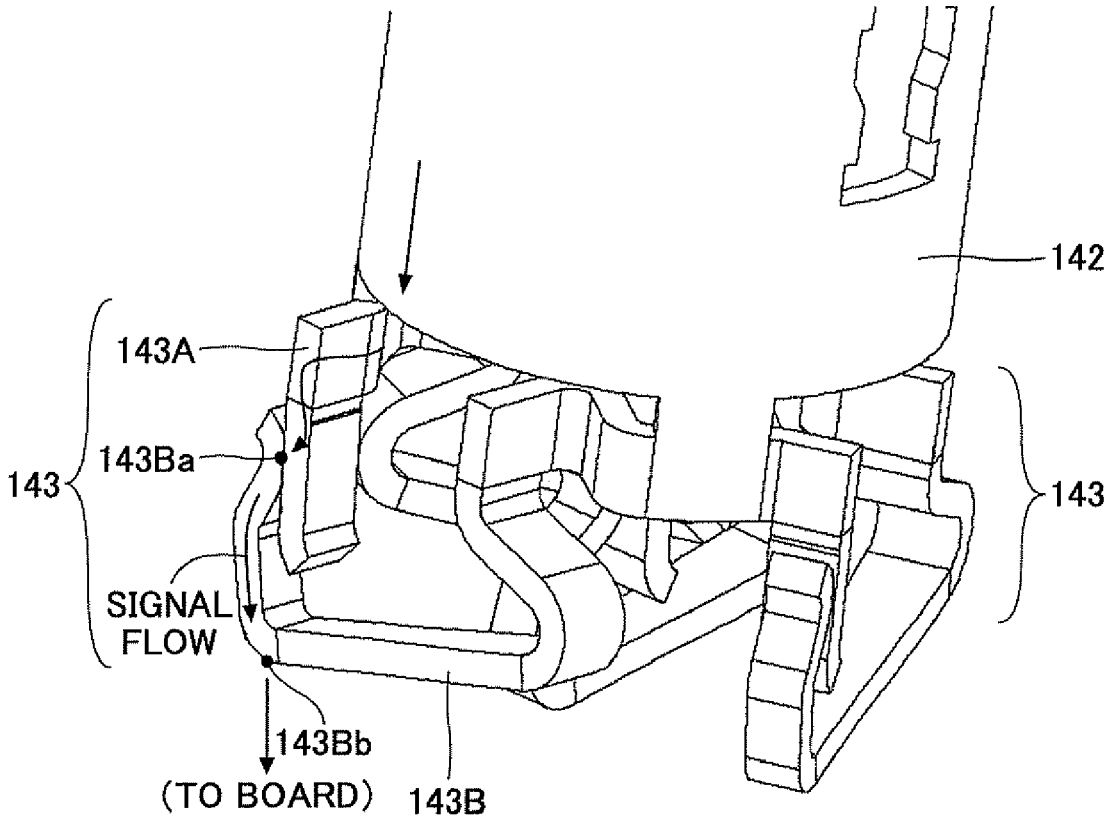
FIG. 20 is an enlarged perspective view of part of the ground contact according to the second embodiment of the present invention.

On the other hand, as illustrated in FIG. 20, which is an enlarged perspective view of part of the ground contact 40, each of the ground contact second terminal parts 143 includes a ground contact first member 143A and a ground contact second member 143B. The ground contact first member 143A may be a first member. The ground contact second member 143B may be a second member.

The ground contact first member 143A extends substantially linearly from the ground contact body part 142 toward the board side. Further, the ground contact second member 143B, which has a curved shape so that an end part 143Ba thereof faces the ground contact first member 143A across a gap, is elastically deformable. The ground contact first member 143A and the ground contact second member 143B are formed by working a plate material serving as a base material by press blanking and further bending the plate material into a predetermined shape as illustrated.

Figure 21:
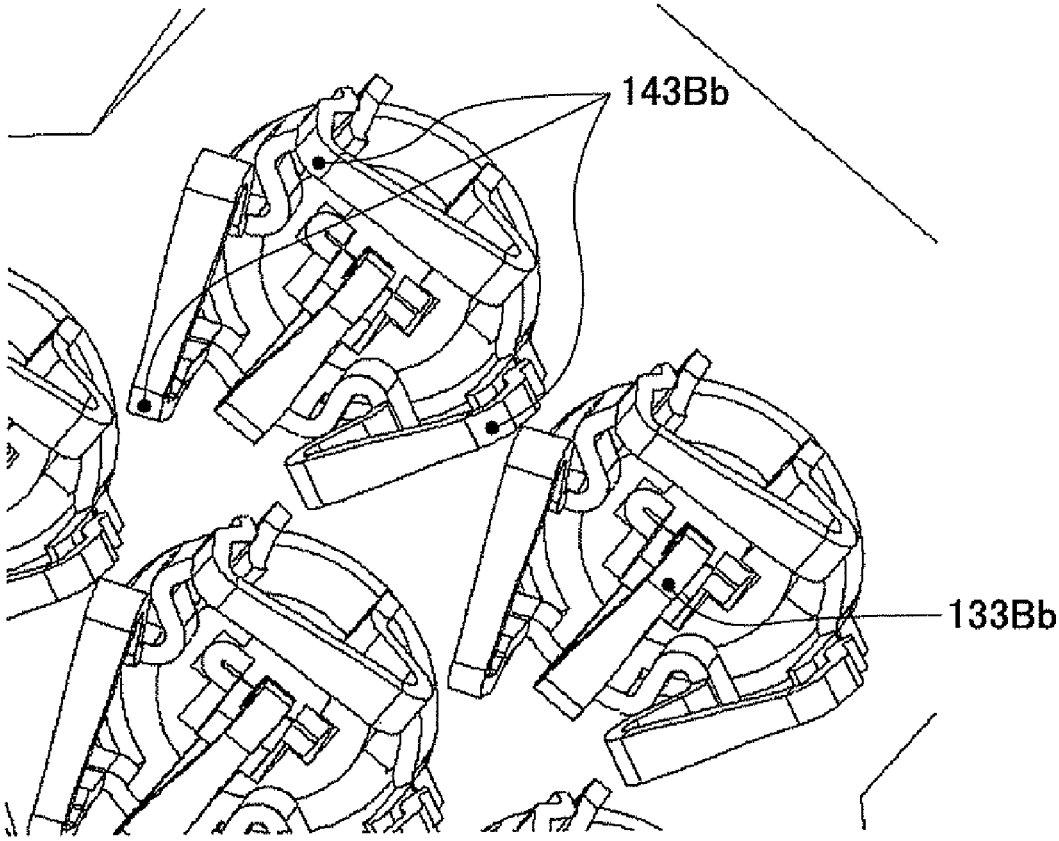
FIG. 21 is an enlarged view of part of the bottom surface of the connector according to the second embodiment of the present invention.

When the connector 100 is attached to the board with screws or bolts, the ground contact second member 143B elastically deforms so that its end part 143Ba comes into press contact with the ground contact first member 143A. Further, a board-side end part 143Bb of the ground contact second member 143B, which is designed to come into contact with a board-side electrode, comes into press contact with a corresponding board-side electrode with the restoring force of the ground contact second member 143B. The board-side end parts 133Bb and 143Bb are also illustrated in FIG. 21, which is an enlarged view of part of the bottom surface of the connector 100.

Signals have the characteristic of being transmitted through a shorter route. Therefore, a signal flows to the board through a transmission path from the ground contact first terminal parts 141 to the board-side end parts 143Bb via the ground contact body part 142, the ground contact first members 143A, and the end parts 133Ba of the ground contact second members 143B.

Thus, according to the connector 100 of this embodiment, contact members are stably connected to the board without being soldered. This facilitates checking or repairing the connector 100.

Further, even if there is attachment error in attaching the signal contacts 130 and/or the ground contacts 140 to the connector housing 120 or even if the connector housing 120, the signal contacts 130, and/or the ground contacts 140 include manufacturing error, such error is absorbed by the elastic deformation of the signal contact second members 133B and/or the ground contact second members 143B.

Further, since the contact points are formed by press contact, it is possible to ensure electrical connection. As a result, the reliability of the connection of the connector 100 and the board is increased.

Further, as illustrated in FIG. 17 and FIG. 20, while the curved members (the signal contact second members 133B and the ground contact second members 143B) may have a certain size to have elastic forces, the signal transmission path may be relatively short. Accordingly, transmission loss, which may be generated depending on transmission path length, is controlled. This makes it possible to respond to high-frequency signal transmission.

The present invention may be applied to the manufacture of computers and their peripheral devices.

According to an aspect of the present invention, a connector is provided whose connection to a board is more reliable and whose mounting on the board is more simplified.

According to an aspect of the present invention, between a first contact part and a second contact part, an elastically deformable third contact part is provided between the first contact part and the second contact part in a contact. Accordingly, even if a board warps or there is manufacturing error in connector components, the third contact part elastically deforms to absorb such a warping of the board or manufacturing error. This increases the reliability of the electrical connection between the contact and the board.

Further, the (second) terminal part of the second contact part is electrically connected to an interconnect of the board by coming into press contact with the interconnect through the elastic force of the third contact part. This makes it unnecessary to fix the terminal part to the interconnect of the board by such a process as soldering, thus facilitating the mounting of the connector onto the board as well as improving the repairability of the connector.

The present invention is not limited to the specifically disclosed embodiments, and variations and modifications may be made without departing from the scope of the present invention.

The present application is based on and claims the benefit of priority of Japanese Priority Patent Applications No. 2008-284133, filed on Nov. 5, 2008, and No. 2009-164113, filed on Jul. 10, 2009, the entire contents of which are incorporated herein by reference.

What is claimed is:

1. A connector, comprising:

a housing to be fixed to a board; and a contact provided in the housing, the contact being configured to be connected to a plug to be attached to the housing, the contact including a first contact part including a body part, a first terminal part provided at a first end of the body part and configured to connect to the plug, and a first connection part provided at a second end of the body part;

one or more second contact parts each including a second terminal part at a first end thereof and a second connection part at a second end thereof, the second terminal part being configured to connect to an electrode provided on the board; and one or more third contact parts each including an elastically deformable elastic part having a first end thereof connected to the first contact part and a second end thereof connected to the second contact part, the third contact part being configured to hold the first connection part and the second connection part so that the first connection part and the second connection part face each other across a gap, wherein the second terminal part is configured to be brought into press contact with the electrode by an elastic force to be generated in the third contact part in response to fixation of the housing to the board, and the third contact part is configured to elastically deform in response to at least one of attachment of the plug to the housing and the fixation of the housing to the board, so as to cause the first connection part and the second connection part to come into contact and be electrically connected.

2. The connector as claimed in claim 1, wherein the contact includes a plurality of the second contact parts and a plurality of the third contact parts with respect to the first contact part.

3. The connector as claimed in claim 1, wherein the second terminal part is larger in width than the second connection part.

4. The connector as claimed in claim 1, wherein the second contact part has an inverse T-letter shape.

5. The connector as claimed in claim 1, wherein the second terminal part is provided with one or more connection projections projecting toward the board.

6. The connector as claimed in claim 1, wherein the second terminal part is configured to come into press contact with an interconnect formed on the board in response to the fixation of the housing to the board.

7. The connector as claimed in claim 1, wherein the body part of the first contact part has a cylindrical shape.

8. The connector as claimed in claim 1, wherein the contact is a signal contact.

9. The connector as claimed in claim 1, wherein the contact is a ground contact.

10. A connector, comprising:

a housing to be fixed to a board; and one or more contacts provided in the housing, the contacts being configured to be connected to corresponding plugs to be attached to the housing, wherein the contacts include a ground contact, the ground contact including a substantially cylindrical ground contact body part;

a first terminal part provided at a first end of the ground contact body part to be connected to a corresponding one of the plugs; and a plurality of second terminal parts extending from a second end of the ground contact body part to be connected to the board, the second terminal parts each including a first member extending from the ground contact main body part toward the board; and a second member having a curved shape so as to have an end part thereof facing the first member across a gap, the second member being configured to be deformed to cause the end part thereof to come into contact with the first member and to be brought into press contact with an electrode of the board by an elastic force generated in the second member by fixation of the housing to the board.

11. The connector as claimed in claim 10, wherein the first member and the second member of each of the second terminal parts extend from different points in a circumferential direction on the second end of the ground contact body part.

12. The connector as claimed in claim 10, wherein the contacts include a signal contact, the signal contact including a signal contact body part surrounded by the ground contact body part;

a third terminal part provided at a first end of the signal contact body part to be connected to a corresponding one of the plugs; and a fourth terminal extending from a second end of the signal contact body part to be connected to the board, the fourth terminal being positioned at a substantial center of the second terminal parts, the fourth terminal including a third member extending from the signal contact body part toward the board; and a fourth member having a curved shape so as to have an end part thereof facing the third member across a gap, the fourth member being configured to be deformed to cause the end part thereof to come into contact with the third member and to be brought into press contact with an electrode of the board by an elastic force generated in the fourth member by the fixation of the housing to the board.

13. The connector as claimed in claim 10, wherein the first terminal part is configured to connect to a contact member of the corresponding one of the plugs at an end-side point and a base-side point thereof.

14. The connector as claimed in claim 10, wherein the connector comprises a plurality of the contacts.

* * * * *